United States Patent [19]

Nakata et al.

[11] Patent Number: 4,862,587

[45] Date of Patent: Sep. 5, 1989

[54] HARNESS PRODUCING APPARATUS AND METHOD

[75] Inventors: Kenji Nakata, Kobe; Kyo Tomonari, Kawanishi; Takeo Yamanaka, Akashi, all of Japan

[73] Assignee: Shin Meiwa Industry Co., Ltd., Nishinomiya, Japan

[21] Appl. No.: 158,287

[22] Filed: Feb. 19, 1988

[30] Foreign Application Priority Data

Feb. 25, 1987 [JP] Japan ..... 62-43890
Sep. 8, 1987 [JP] Japan ..... 62-224995

[51] Int. Cl.[4] ..... H01R 43/04

[52] U.S. Cl. ..... 29/867; 29/564.4; 29/564.6; 29/753; 29/872

[58] Field of Search ..... 29/857, 861, 863, 867, 29/748, 753, 755, 872, 749, 564.4, 564.1, 564.6

[56] References Cited

FOREIGN PATENT DOCUMENTS 23633 6/1984 Japan .

*Primary Examiner*—Carl E. Hall
*Attorney, Agent, or Firm*—W. G. Fasse; D. H. Kane, Jr.

[57] ABSTRACT

A wire harness is produced by attaching terminals to one of the respective ends of a plurality of wires and gathering the other ends and attaching a single terminal thereto. The plurality of insulated wires are intermittently fed by respective predetermined lengths along predetermined feed paths, and then cut to respective predetermined lengths to provide remaining wires and cut wire sections. The insulation on the forward ends of the remaining wires and on the rear ends of the cut wire sections, next to the cut just made, are stripped. Terminals are crimped to insulation-stripped ends of the remaining wires. The cut wire sections are transferred so that their insulation-stripped ends are gathered in one place and then the insulation-stripped ends of the cut wire sections are trued-up and a single terminal is crimped thereto to form a single terminal for the plurality of cut wire sections.

8 Claims, 19 Drawing Sheets

(STATE OF t1 = t17)

(STATE OF t10)

FIG. 14 (STATE OF t15)

HARNESS PRODUCING APPARATUS AND METHOD

FIELD OF THE INVENTION

The present invention relates to an apparatus and method for automatically producing so-called pine needle-shaped harnesses wherein a plurality of wires have terminals attached thereto at one of their respective ends and the other ends are gathered and a single terminal is attached thereto.

DESCRIPTION OF THE PRIOR ART

Japanese patent publication No. 23633/1984 discloses a terminal crimping machine which performs continuously and automatically the following operations: feeding of insulated wires by predetermined lengths in each operating cycle, cutting of the insulated wires to predetermined lengths, stripping insulation from the cut ends, and crimping of terminals to one of the respective insulation-stripped ends.

Heretofore, methods of producing the pine needle-shaped harnesses included the steps of first producing a number of wires each having a terminal attached to one end alone by the continuous terminal crimping machine, the other end being left bare with the insulation stripped therefrom, the operator then picks up a required number of wires in each cycle, trues up the insulation-stripped ends, and presents the wires over the crimping bed of another terminal crimping machine, and then the operator crimps a single terminal onto these trued-up insulation-stripped ends by operating a manual switch.

The pine needle-shaped harness producing method described above involves manual operations between the step of producing a number of wires having terminals crimped to one of their respective ends and the step of trueing-up the other insulation-stripped ends and crimping a single terminal thereto. Thus, the method is inefficient and, moreover, in the case of thin wires, since the core tends to loosen, a high degree of skill is required to true-up the ends of a plurality of thin wires. Further, the wires are not always of the same size; they differ in size according to their wiring location and wiring path, and the wires are very difficult to handle once they leave the continuous terminal crimping machine.

SUMMARY OF THE INVENTION

Accordingly, an object of the invention is to provide a harness producing apparatus and method capable of solving the problems described above by reducing the need for manual operations.

A harness producing apparatus according to this invention comprises: wire feeding means for intermittently feeding predetermined lengths of a plurality of insulated wires along predetermined feed paths, wire cutting means and insulating cutting means for cutting off from said insulated wires, insulated cut wire sections having said predetermined lengths to form remaining wire ends and said cut wire sections, and for cutting insulation on said remaining wire ends and on said cut wire sections, insulation stripping means for moving said remaining wire ends and said cut wire sections in the direction of said feed paths so as to strip off cut insulation from said remaining wire end and from ends of said cut wire sections, single-wire terminal crimping means for crimping a terminal to each insulation-stripped remaining wire end of said insulated wires, transfer means including clamp means for parallely nipping insulation-stripped ends of said cut wire sections to bring said insulation-stripped ends of said cut wire sections into a trued-up state and for transferring insulation-stripped ends of said cut wire sections at right angles to said feed paths, positioning means for nipping said insulation-stripped ends of said cut wire sections in said trued-up state and for presenting said insulation-stripped ends of said cut wire sections to a crimping position, and plurality-of-wires terminal crimping means for crimping one terminal to all said insulation-stripped ends of said cut wire sections.

According to this invention the steps necessary for the production of harnesses, such as the cutting of insulated wires, the stripping of insulations from the ends of the wires, and the crimping of terminals to the insulation-stripped ends of the cut wires can be effected continuously without the need for performing manual operations in the process. Therefore, the production efficiency has been increased, costs have been decreased, and the product quality has been improved.

In a preferred embodiment, an endless chain intermittently driven in one direction is installed to serve as means for transferring a plurality of cut wires to a position where a terminal is crimped in such a manner that the trued-up insulation-stripped ends of the cut wire sections are united by a common crimped terminal. With the calculation of such endless chain, the cut wires are fed to a terminal crimping station and upon completion of the crimping, the cut wires are released.

These objects and other objects, features, aspects and advantages of the present invention will become more apparent from the following detailed description of the present invention when taken in conjunction with the accompanying drawings.

BRIEF DESCRIPTION OF THE DRAWINGS

In order that the invention may be clearly understood, it will now be described, by way of example, with reference to the accompanying drawings, wherein:

FIG. 16 is a complete schematic plan view of said other embodiment;

FIG. 17 is an enlarged view taken along the line XVII—XVII in FIG. 16;

FIGS. 18 to 22 are function-explaining views; and

FIG. 23 is an enlarged front view taken along the line XXIII—XXIII in FIG. 20.

DETAILED DESCRIPTION OF THE PREFERRED EMBODIMENTS AND OF THE BEST MODE OF THE INVENTION

A harness producing apparatus according to an embodiment of the present invention will now be described with reference to the drawings. For convenience of description, the left and right in FIGS. 1, 4, 5, 6, 7, 9, 10, 11 and 12 will be called the "left" and "right", respectively, and the right and left in FIGS. 2, 13 and 14 will be called "front" and "rear" or "downstream" and "upstream", respectively.

Figure 1:
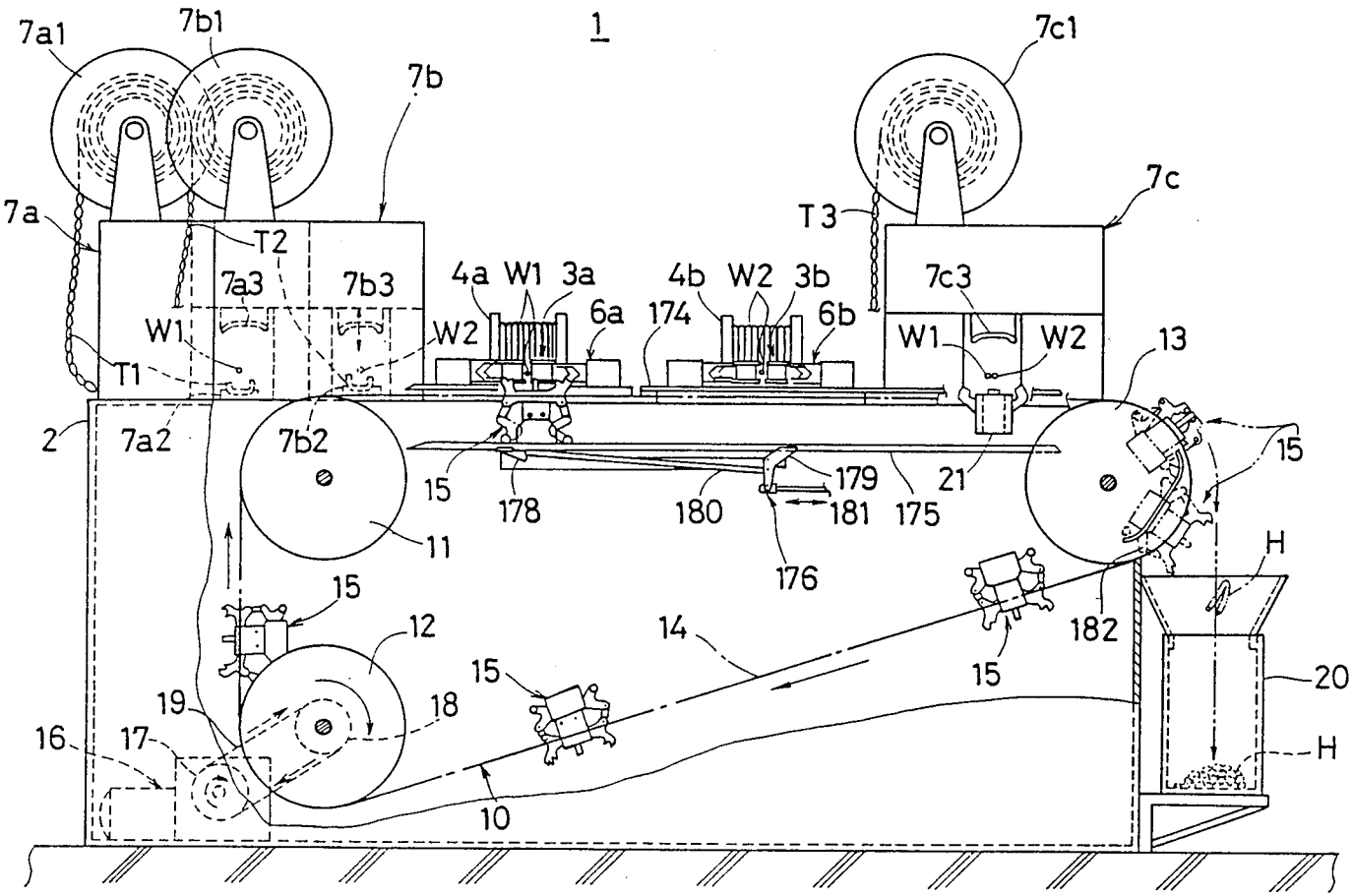
FIG. 1 is a complete front view of a harness producing apparatus.
Figure 2:
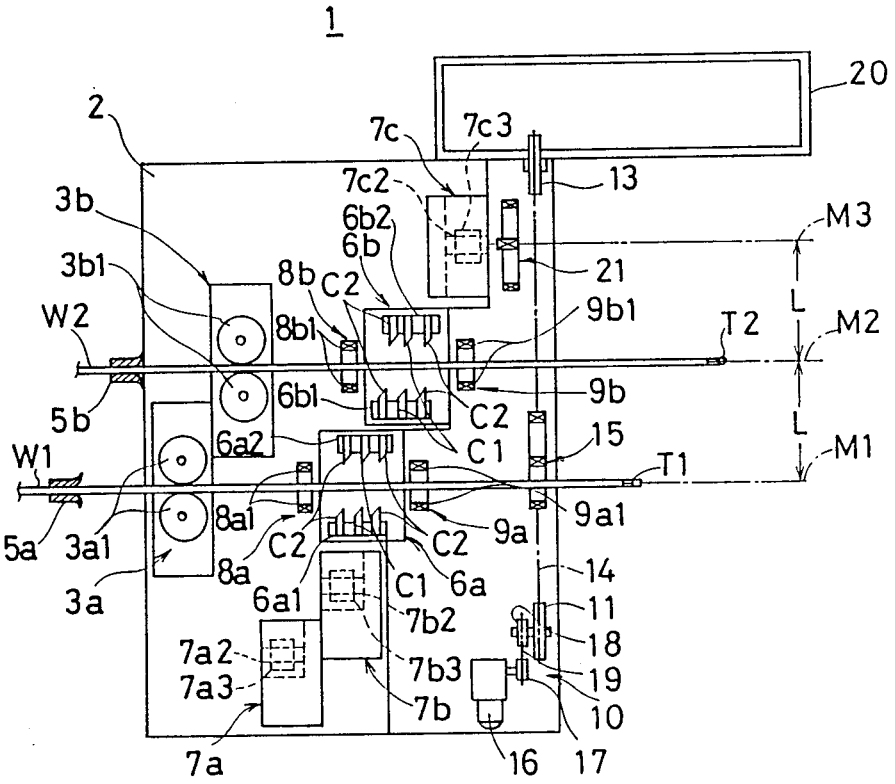
FIG. 2 is a complete schematic plan view of the harness producing apparatus.
Figure 3:
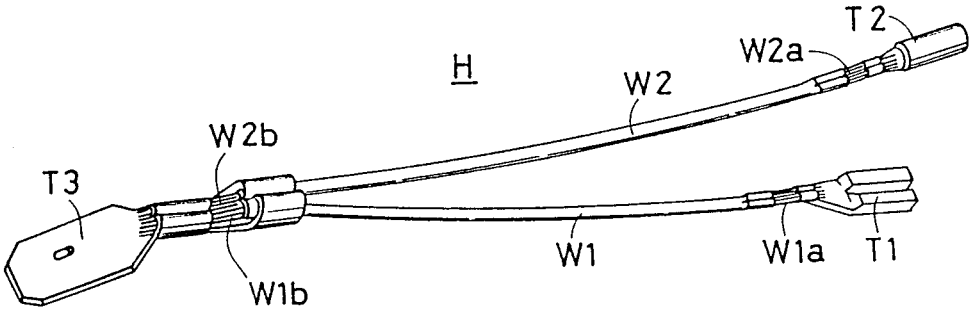
FIG. 3 is a harness produced by the harness producing apparatus.

FIG. 1 is a front view of a harness producing apparatus 1, and FIG. 2 is an overall schematic plan view of the harness producing apparatus 1. The harness producing apparatus 1 is adapted to automatically and continuously produce a so-called "pine needle-shaped" harness H, as shown in FIG. 3, by fastening terminals T1 and T2 to one of the respective ends of two, first and second wires W1 and W2, putting the other ends thereof together and then fastening a common terminal T3 thereto.

The apparatus includes a machine box 2 carrying first and second wire length measuring and feeding mechanisms 3*a* and 3*b* disposed in spaced relationship on the rear region of the upper surface of the machine box 2. The mechanisms 3*a* and 3*b* respectively comprise pairs of first and second feed rollers 3*a*1 and 3*b*1 associated with a length measuring mechanism (not shown) and adapted to be transversely moved toward and away from each other for a closing and an opening movement. The first and second feed rollers 3*a*1 and 3*b*1 are adapted to rotate with first and second wires W1 and W2 nipped between the rollers. The wires are delivered through guide tubes 5*a* and 5*b* from first and second stock rollers 4*a* and 4*b* disposed on the machine box 2 in the rear region thereof, so as to feed them forward intermittently by predetermined lengths during each operating cycle along the longitudinally extending first and second feed axes M1 and M2 defining respective feed paths.

First and second cutting mechanisms 6*a* and 6*b* for cutting the wires and for cutting the insulation on the wires are disposed on the forward region of the upper surface of the machine box 2 forwardly of said first and second wire length measuring and feeding mechanisms 3*a* and 3*b*. The cutting mechanisms 6*a* and 6*b* comprise pairs of cutter blocks 6*a*1, 6*a*2 and 6*b*1, 6*b*2 respectively adapted to be transversely moved toward and away from each other on opposite sides of the first and second feed axes M1 and M2 for a closing and an opening movement. The cutter blocks 6*a*1, 6*a*2 and 6*b*1, 6*b*2 comprise opposed two-in-a-set core cutting blades C1 and two sets of insulation cutting blades C2. Each set has two insulation cutting blades C2 disposed in parallel opposed relationship on the upstream and downstream sides of the core cutting blades C1.

First and second terminal crimping units 7*a* and 7*b* for crimping single-wire terminals, are disposed on the upper surface of the machine box 2 in a longitudinally and transversely shifted relationship on the left-hand side of the first cutting mechanism 6. The crimping units 7*a* and 7*b* respectively comprise terminal feeding reels 7*a*1 and 7*b*1 and crimping beds 7*a*2 and 7*b*2 for mounting terminals T1 and T2 on these beds respectively one at a time. The terminals initially form chains pulled from said reels. The crimping units further include crimping dies 7*a*3 and 7*b*3 disposed so that they can be lowered toward the crimping beds 7*a*2 and 7*b*2 positioned in the rear region. The dies 7*a*3 and 7*b*3 are transversely spaced from each other to avoid interfering with each other. The right-hand die side is opened to allow the first and second wires W1 and W2 to transversely come in and out above the crimping beds 7*a*2 and 7*b*2. A third terminal crimping unit 7*c* serves as a means for crimping a plurality of terminals. The unit 7*c* is disposed on the upper surface of the machine box 2 in the right-hand side of the second cutting mechanism 6*b*. The unit 7*c* comprises a crimping bed 7*c*2 disposed in a front middle region for mounting terminals T3, one at a time thereon. Terminals T3 are also delivered in chain form from a terminal feed reel 7*c*1. The unit 7*c* further includes a crimping die 7*c*3 disposed so that it can be lowered from above toward said crimping bed 7*c*2. In addition, the center line M3 of said crimping bed 7*c*2 is spaced to the right from the second feed axis M2 by a distance corresponding to the distance L between the first and second feed axes M1 and M2.

First and second upstream clamps 8*a* and 8*b* are disposed between the first wire length measuring and feeding mechanism 3*a* and the first cutting mechanism 6*a* and between the second wire length measuring and feeding mechanism 3*b* and the second cutting mechanism 6*b* respectively. Each clamp 8*a* and 8*b* comprises a pair of clamp pwals 8*a*1 and 8*b*1 adapted to be opened and closed. The clamp pawls 8*a*1 and 8*b*1 are movable along the first and second feed paths defined by the axes M1 and M2. These clamps are also movable transversely to positions behind the crimping beds 7*a*2 and 7*b*2, respectively.

First and second downstream clamps 9*a* and 9*b* are disposed downstream of said first and second cutting mechanisms 6*a* and 6*b*, respectively. Each downstream clamp 9*a* and 9*b* comprises a pair of nip pawls 9*a*1 and 9*b*1 which can be opened and closed. These nip pawls are movable as a unit along the first and second feed paths defined by the axes M1 and M2, respectively.

A transfer conveyor 10 is substantially completely enclosed in the machine box 2 in the front region thereof. The conveyor 10 comprises three sprockets 11, 12 and 13 supported at upper and lower left and upper right positions, an endless chain 14, which is ten times as long as the distance L, extending around said sprockets 11, 12 and 13. Five transfer clamps 15 are attached to the endless chain 14 with a pitch twice as long as the distance L. A drive unit 16 including a brake and a speed reducer motor drives the conveyor through a toothed belt 19 mounted between a toothed driving pulley 17 fixed on the output shaft of the motor and a toothed driven pulley 18 fixed on the shaft of the sprocket 12. When the motor 16 is energized, the endless chain 14 and the transfer clamps 15 are driven intermittently in a clockwise direction with said distance L being one pitch as viewed in FIG. 1. The upper right sprocket 13 has its right-hand portion projecting rightwardly from the machine box 2, and a chute-equipped container 20 is disposed just below the sprocket 13. A positioning clamp 21 is disposed forwardly of the crimping bed 7c2 of the third terminal crimping unit 7c.

The transfer clamps 15 and an opening and closing mechanism for these transfer clamps 15 will now be described with reference mainly to FIGS. 4 to 9.

A support member 151 having a lower surface recess 151a through which said endless chain 14 is passed is firmly connected to the endless chain 14 by a support pin 12 also serving as one of the link pins for the endless chain 14. A vertical plate-like attached member 153 is fixed at its middle to the rear end depending portion 151b of the support member 151 by bolts 154 at two places. Left and right pawl members 155 and 156 having recesses 151a1 and 156a1 in their lower portions 155a and 156a are fitted over the upper left and right corners of the attaching member 153. The pawl members 155 and 156 are pivotally connected to the attaching member 153 by pivot pins 157a and 157b. Each pawl member has two pawls 151b1 and 156b1 respectively at the left and right opposed surfaces of its upper portion 155b and 156b respectively. These pawls are spaced and V-shaped and project from the respective pawl. Said left-hand pawl member 155 has arcuate toothed portions 155a1 with its center located at the pivot point of said pin 157a, with teeth formed in both the front and rear lower portions 155a, whereby the recess 155a1 divides the front and rear. Further, said right-hand pawl member 156 has projections 156a2 on the front and rear outer peripheral regions of the lower portions 156a divided by the recess 156a1, the arrangement being such that said projections 156a2 engage a stopper pin 158 extending through the upper right portion of said attaching member 153 for limiting the opening movement of the right-hand pawl member 156. The left and right pawl members 155 and 156 have U-shaped intermediate projections 155c and 156c on the left and right intermediate portions, respectively. A tension spring 161 is installed under tension between the forwardly projecting portions of support pins 159 and 160 extending through and fixed to recesses 155c1 and 156c1 in said intermediate portion 155c and 156c.

Upper and lower pairs of opening and closing links 162, 163 and 164, 165 are associated with the left and right pawl members 155 and 156. The upper portions of the upper links 162 and 164 are fitted in the recesses 155c1 and 156c1 and pivotally connected thereto by said support pins 159 and 160. The lower portions of the upper links 162, 164 have connecting pins 166 and 167 extending therethrough and fixed thereto. The upper and lower portions of the lower links 163 and 165 have recesses 163a, 163b and 165a, 165b. The lower recesses 163b and 165b receives the left and right upper corners of the lower enlarged extension 153a of said attaching member 153. The lower links 163 and 165 are tiltably supported on the lower extensions 153a by pivot pins 168 and 169. The front and rear walls forming said upper recesses 163a and 165a have elongated openings 163a1 and 165a1, and the lower portions of the upper links 162 and 164 are fitted in the upper recesses 163a and 165a. The connecting pins 166 and 167 are displaceably fitted in the elongated openings 163a1 and 165a1. Thus, an articulated construction for each of the upper and lower links 162, 163 and 164, 165 is achieved. Driven rollers 170, 171 are pivotally connected to and project from the lower left and right regions of the lower links 163 and 165.

A vertically extending slender intermediate lifting pawl member 172 has comb-like intermediate pawls 172a on the upper left and right lateral surfaces thereof. A narrow portion 172b of the member 172 below said intermediate pawl 172a is slidably fitted in a longitudinal vertical guide opening 153b for a vertical movement. The guide opening 153b is located in the middle region of the attaching member 153. The left-hand end surfaces of front and rear wide portions 172c projecting forwardly and rearwardly of the attaching member 153 are provided with racks 172c1 extending from the middle regions to the lower ends. A pair of front and rear pinions 173 is pivotally mounted at the leftward portion on a common shaft on the front and rear surfaces of said attaching member 153. The pinions 173 mesh constantly with the teeth 155a2 and racks 172c1, whereby the pinions are rotated with the opening and closing tilting movement of said left-hand pawl member 155, thereby lifting and lowering the intermediate lifting pawl member 172.

Figure 7:
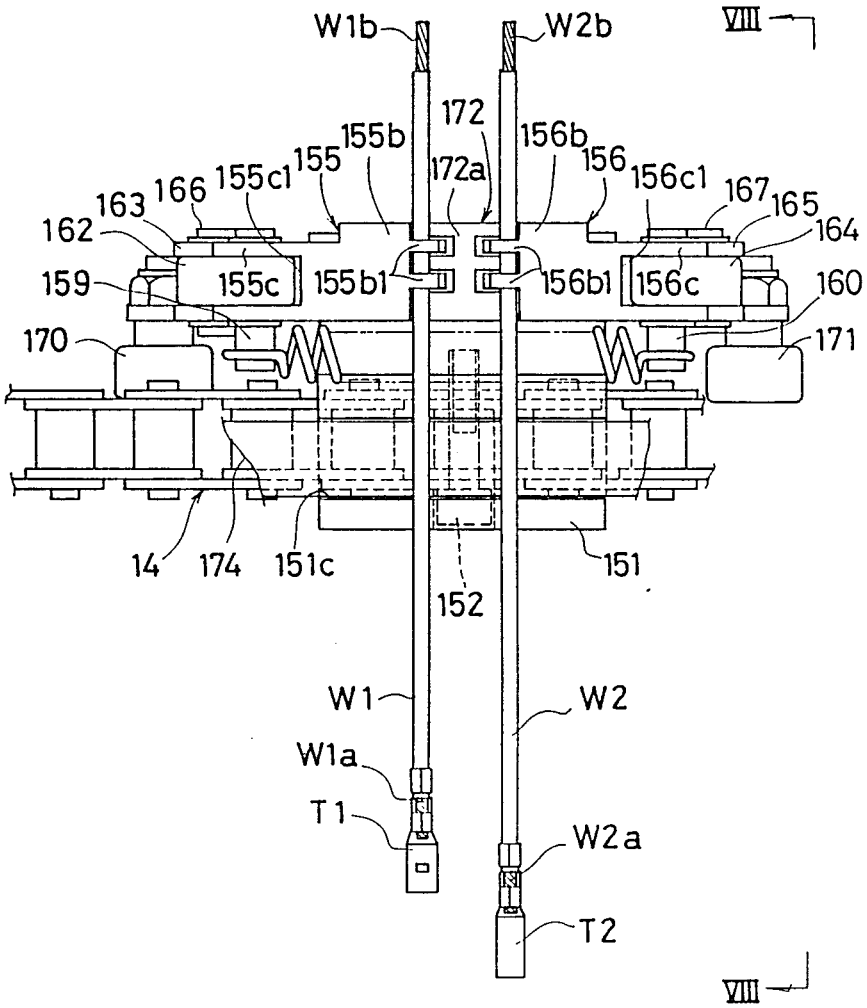
FIG. 7 is a plan view taken in the direction of arrow VII—VII in FIG. 6.
Figure 8:
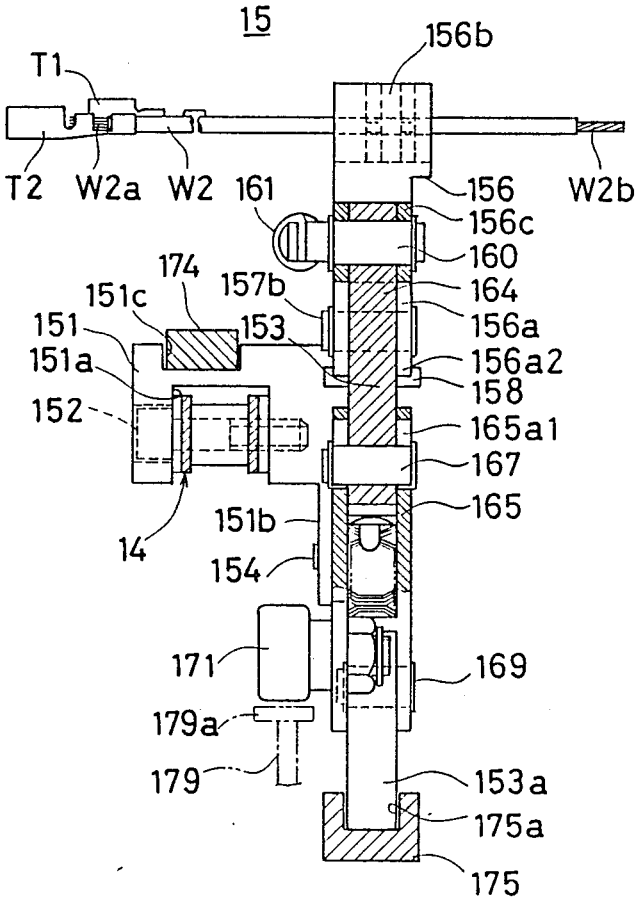
FIG. 8 is a side view taken in the direction of arrow VIII—VIII in FIG. 7.
Figure 9:
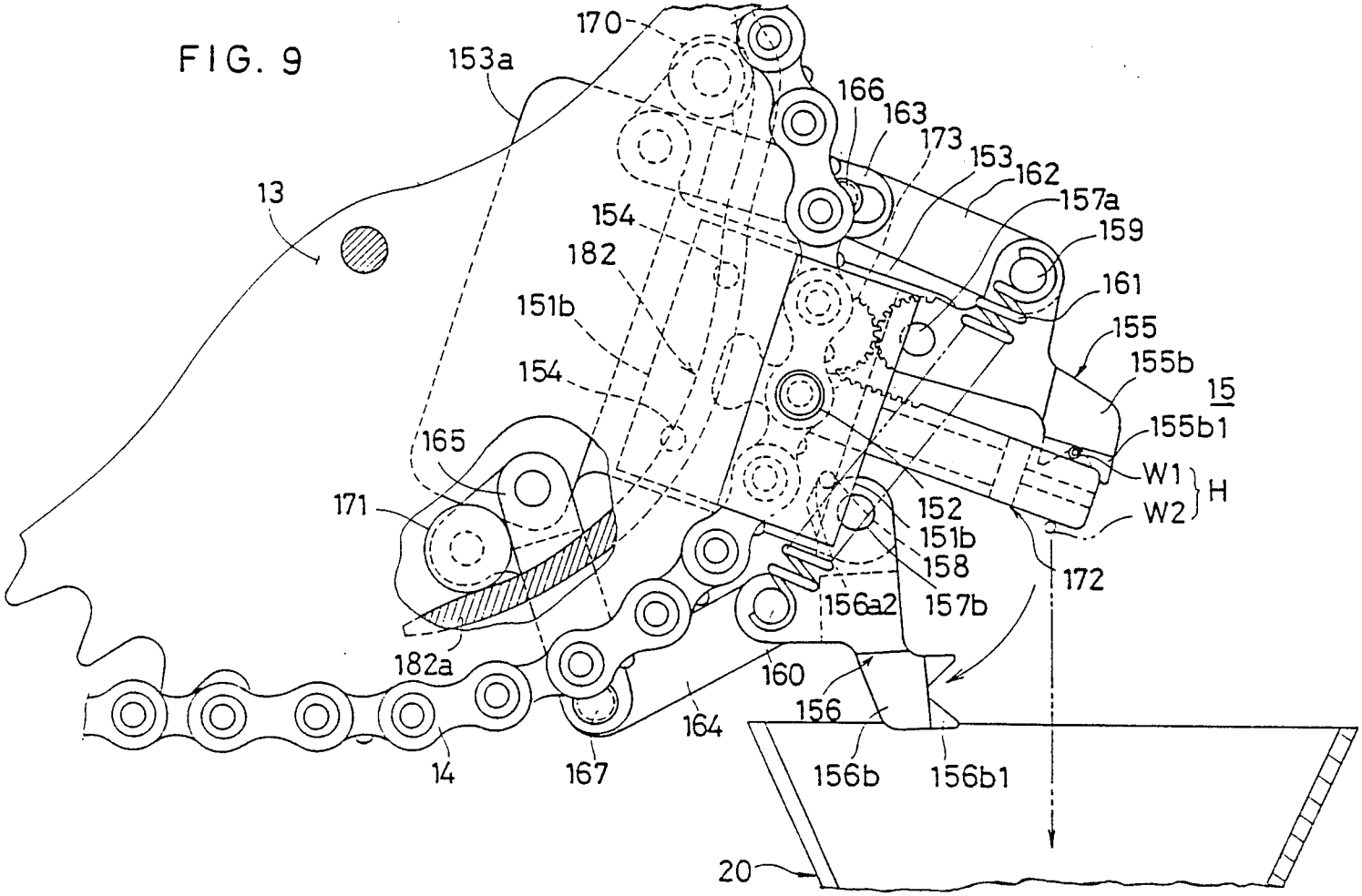
FIG. 9 is a detailed plan view of the transfer clamp in the half-opened state, showing how a harness is released.

Upper and lower guide rails 174 and 175 extend substantially over the entire length of the horizontal path of travel of the endless chain 14 between said sprockets 11 and 13. The upper guide rail 174 as shown in FIGS. 7 and 8, fits in a guide groove 151c in the upper surface of the support member 151 for the transfer clamps 15 when the transfer clamps 15 are moved along the horizontal path of travel. The lower guide rail 175 has a U-shaped guide groove 175a which receives the lower end of the lower enlarged extension 153a for guiding the transfer clamps 15 during their horizontal movement.

Figure 4:
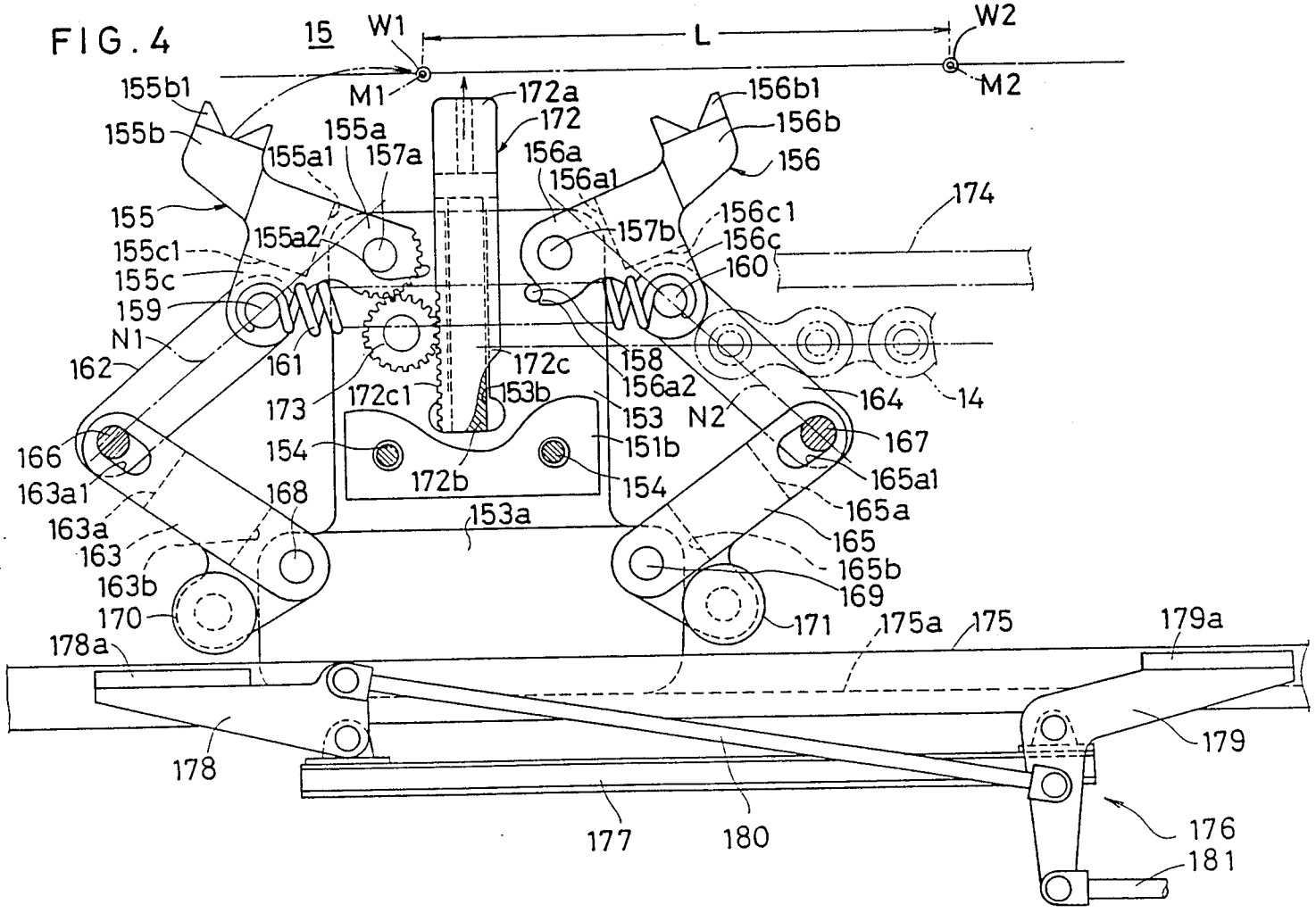
FIG.4 is a detailed front view of a transfer clamp in the fully opened state.
Figure 5:
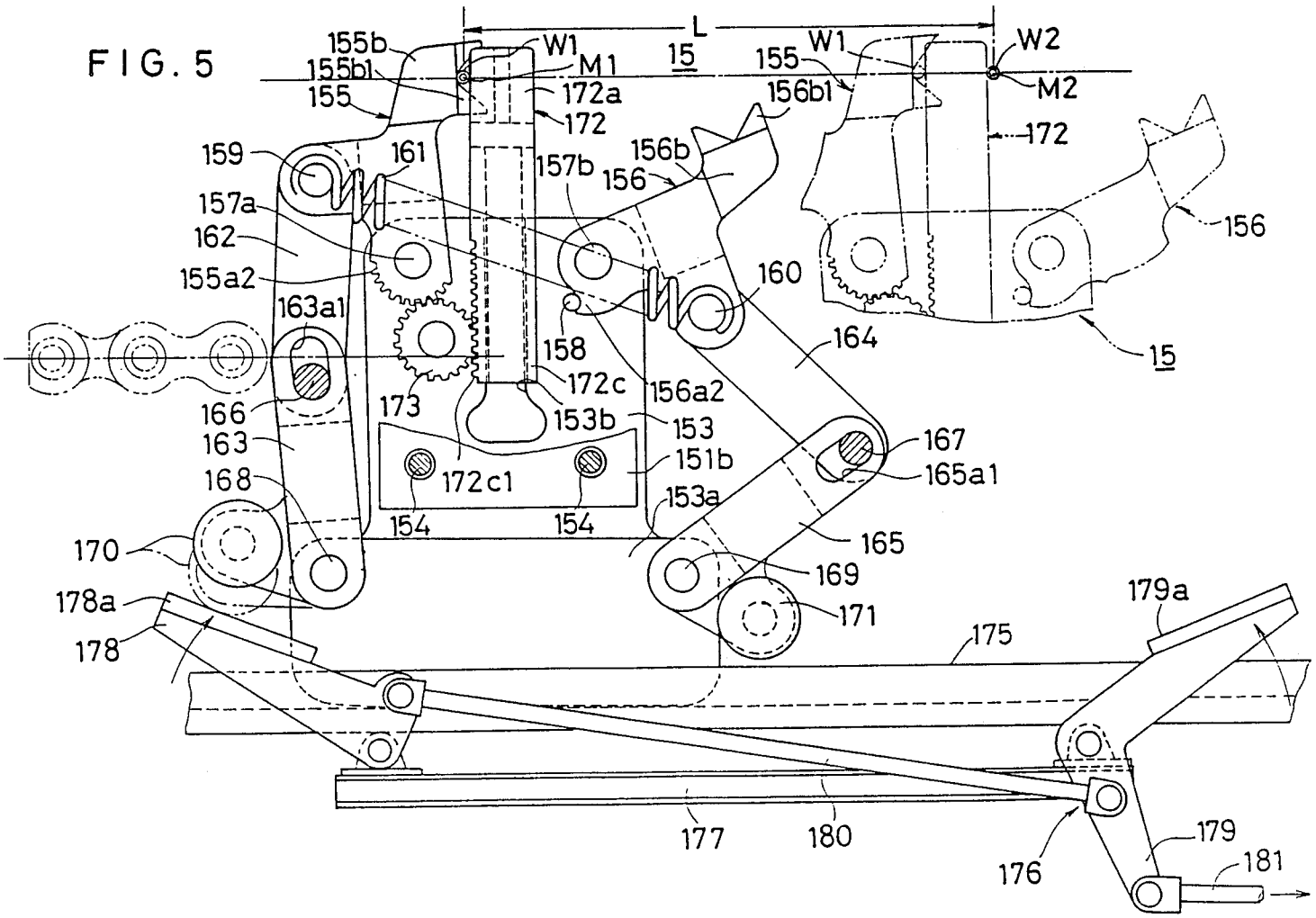
FIG. 5 is a detailed front view of the transfer clamp in the half-opened state.

Thus, the transfer clamps 15 are normally held in the open state shown in FIG. 4. That is, the upper and lower links 162, 163 and 164, 165 are bent outwardly and the left and right pawl members 155 and 156 are tilted counterclockwise and clockwise, respectively, as viewed in FIG. 4. At this time, the intermediate lifting pawl member 172 is lowered by the pinions 173 until the lower end of the narrow portion 172b abuts against the bottom of the vertical guide opening 153b, whereby a further tilting of the left-hand pawl member 155 in the opening direction is prevented by the pinions 173. Further, the right-hand pawl member 156 is prevented from further tilting in the opening direction since the projection 156a2 is engaged with the stopper pin 158. The tension spring 161 extends between the support pins 159 and 160 below the pivot pins 157a and 157b of the left and right pawl members 155 and 156 for maintaining the opened state of the left and right pawl members 155 and 156 and for maintaining the lowered state of the intermediate lifting pawl member 172. The connecting pins 166 and 167 are positioned in the front ends of the elongated openings 163a1 and 165a1, while the center line N1 connecting the connecting pin 166 and the support pin 159 and the center line N2 connecting the connecting pin 167 and the support pin 160, extend above the pivot pins 157a and 157b, respectively. A closing mechanism 176 for the transfer clamps 15 is disposed forwardly of the lower guide rail 175. The closing mechanism comprises a horizontal fixed channel member and left and right push members 178, 179 for closing the left and right pawl members 155 and 156. The left-hand push member 178 is pivotably connected at its base, for a tilting movement in a vertical plane, to said fixed channel member 177. The member 178 has an abutment plate 178a fixed on its upper surface, at the front end. The plate 178a extends to the left. The right-hand push member 179 in the form of a bent link, is pivotally connected, for a tilting movement in a vertical plane, at its intermediate bend to said fixed channel member 177 at a place somewhat spaced to the right and just below said second feed axis M2. The member 179 has an abutment plate 179*a* fixed on its upper surface, at one end. The plate 179*a* extends to the right. The left and right push members 178 and 179 are connected to each other by a connecting rod 180 extending between points equispaced upwardly and downwardly from their respective pivotal points on the fixed channel member 177. An actuator rod 181 is pivotally connected at one end thereof to the front end of the other side of the right-hand push member 179. The rod 181 is normally pushed to the right by a cam mechanism not shown so that the abutment plates 178*a* and 179*a* are retracted to a lower position where they do not interfere with the travel of the transfer clamps 15.

An opening mechanism 182 for opening the transfer clamps 15 is disposed adjacent the rear surface of the sprocket 13. The opening mechanism 182 comprises a fixed cam 182*a* curved from adjacent the outer periphery of the sprocket 13 somewhat above and to the right-hand side of the axis of the sprocket 13 downwardly to approach said axis, so that when the transfer clamps 15 are rotated clockwise around the sprocket 13, the driven rollers 171 and 170 successively engage the inner surface of the fixed cam 182*a*, whereby the lower links 165 and 163 are tilted clockwise and counterclockwise, respectively, as viewed in FIG. 9 and are bent together with the upper links 164 and 162 for opening the right-hand pawl member 156 and then the left-hand pawl member 155.

Figure 10:
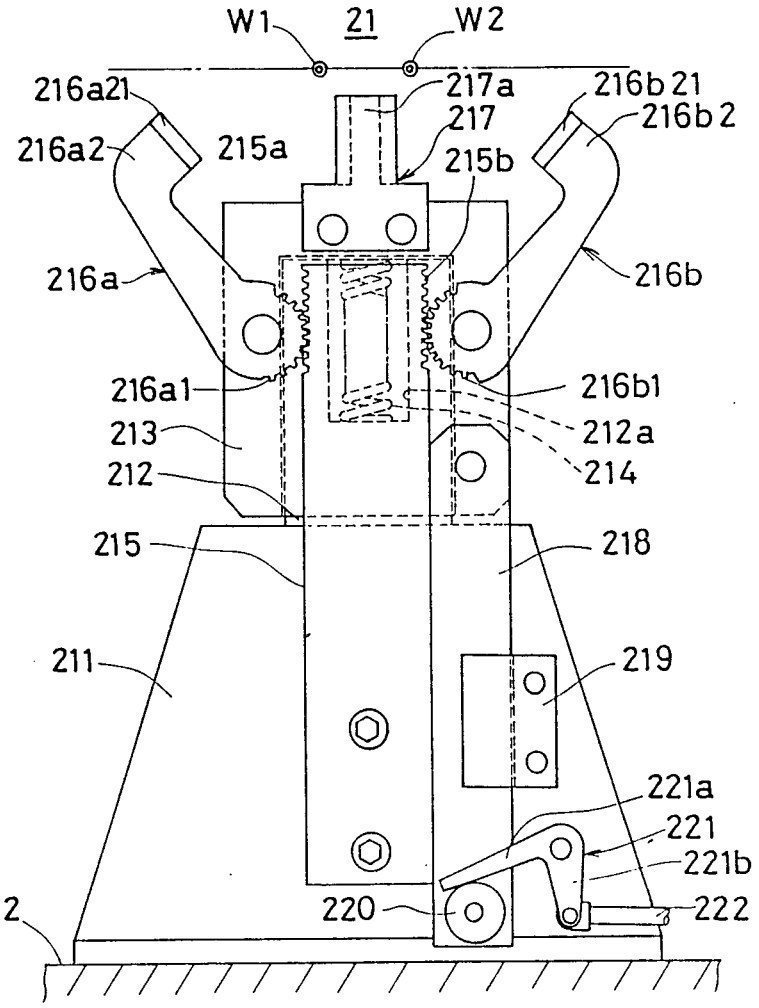
FIGS. 10 and 11 are detailed front views of a positioning clamp in the opened and closed states, respectively.
Figure 11:
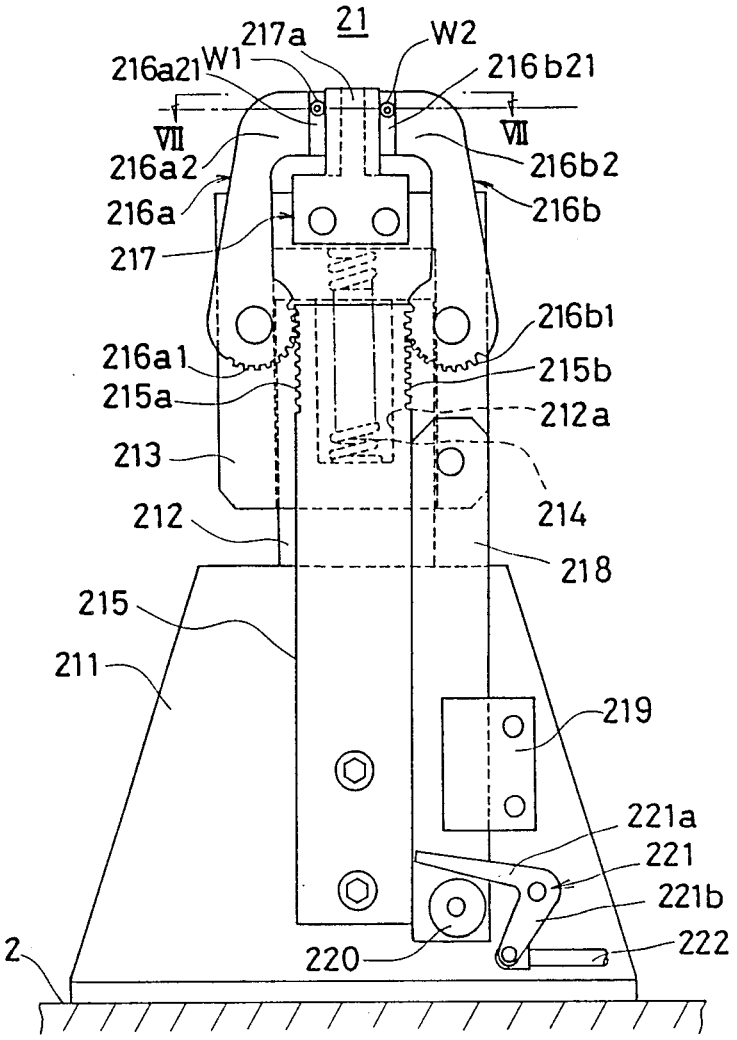
Figure 12:
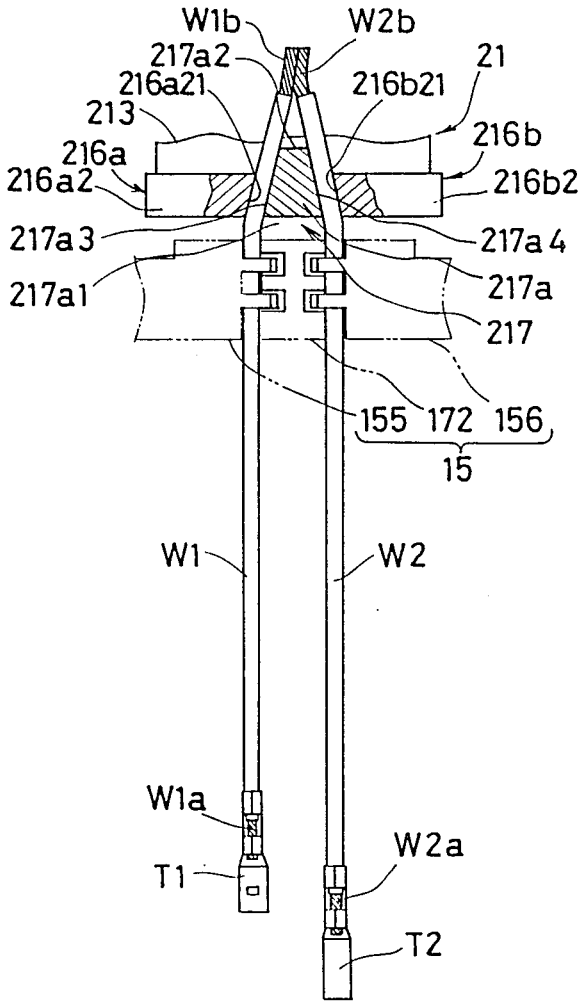
FIG. 12 is a plan view taken in the direction of arrow XII—XII in FIG. 11.

The positioning clamp 21 will now be described in detail with reference to FIGS. 10 to 12. A base member 211 is fixed to a portion of the machine box 2. A lifting cap member 213 is vertically slidably fitted on a vertical plate 212 erected on said base member 211. The lifting cap member 213 is resiliently biased by the force of a compression spring 214 housed in a vertical opening 212*a* in the upper surface of said vertical plate member 212. A fixed upwardly extending rack member 215 is secured at its lower end to the front surface of said base member 211. The rack member 215 has racks 215*a* and 215*b* on its upper opposite lateral surfaces. Positioning right and left members 216*a* and 216*b* have sector gears 216*a*1 and 216*b*1 meshing with said racks 215*a* and 215*b*. The members 216*a* and 216*b* are pivotally connected to the left and right intermediate regions of the front surface of the lifting cap member 213. The pawl members 216*a* and 216*b* have nip pawls 216*a*2 and 216*b*2 at the front left and right opposed surfaces thereof. The nip pawls 216*a*2 and 216*b*2 form inclined planar surfaces 216*a*21 and 216*b*21 extending rearwardly, as viewed in a plan view, toward each other (see FIG. 12). A raised positioning intermediate pawl member 217 is fixed at its lower end to the upper middle region of the front surface of said lifting cap member 213. The cross-section of the upper pawl 217*a* is substantially in the form of a trapezoid with a long front side 217*a*1 and a short rear side 217*a*2 and with left and right inclined surfaces adapted to register with the inclinded surfaces of said nip pawls 216*a*2 and 216*b*2, the rear short side thereof extending rearwardly beyond the rear surfaces of the pawl members 216*a*2 and 216*b*2.

A driven member 218 has an upper portion supported at the right-hand lower portion of the front surface of the lifting cap member 213, whereby the driven member 218 is supported for a vertical movement, by the left-hand side surface of the fixed rack member 215 as guided by a guide member 219 fixed to the base member 211. The driven member 218 supports a driven roller 220 on the lower region of the front surface thereof. An operating bent arm 221 is pivotally connected at its intermediate bend to the right-hand lower region of the front surface of said base member 211, with one end side 211*a* thereof extending over said driven roller 220. An operating rod 222 is pivotally connected at one end thereof to the other end 211*b* of the operating bent arm 221, whereby the operating rod 222 is normally held pulled to the right by a cam mechanism not shown. Thus, the operating bent arm 221 is engaged at said one end 221*a* with the upper surface of the driven roller 220 for lowering the lifting cap member 213 to the lowermost position against the compression spring 214 through the driven roller 220 and driven member 218. At this time, the positioning left and right pawl members 216*a* and 216*b* are opened since their sector gears 216*a*1 and 216*b*1 mesh with the lower portions of the racks 215*a* and 215*b*. The upper ends of the nip pawls 216*a*2 and 216*b*2 are in the opened state and the upper end of the positioning intermediate pawl member 217 is positioned below two wires W1 and W2 being transferred by said transfer clamps 15. Thus, when said transfer clamp 15 stops in front of the positioning clamp 21 and the operating rod 222 is pushed to the left, the operating bent arm 221 is tilted clockwise as viewed in FIGS. 10 and 11, so that the lifting cap member 213 is lifted by the action of the force of the compression spring 214. Therefore, the upper pawl 217*a* of the positioning intermediate pawl member 217 is lifted to enter the space between the two wires W1 and W2 held in parallel to each other by the transfer clamp 15 while the left and right pawl members 216*a* and 216*b* are lifted with their sector gears 216*a*1 and 216*b*1 meshing with the racks 215*a* and 215*b* so that the pawl members are titled toward each other until they are closed with the wires W1 and W2 forming cut wire sections held nipped between the opposed inclined surfaces of the nip pawls 216*a*2 and 216*b*2 and the left and right inclined surfaces of the upper pawl 217*a*, whereby the two wires W1 and W2 gradually converge toward their rear ends until the rear insulation-stripped end portions W1*b* and W2*b* are gathered together and trued up (see FIG. 12).

Figure 15:
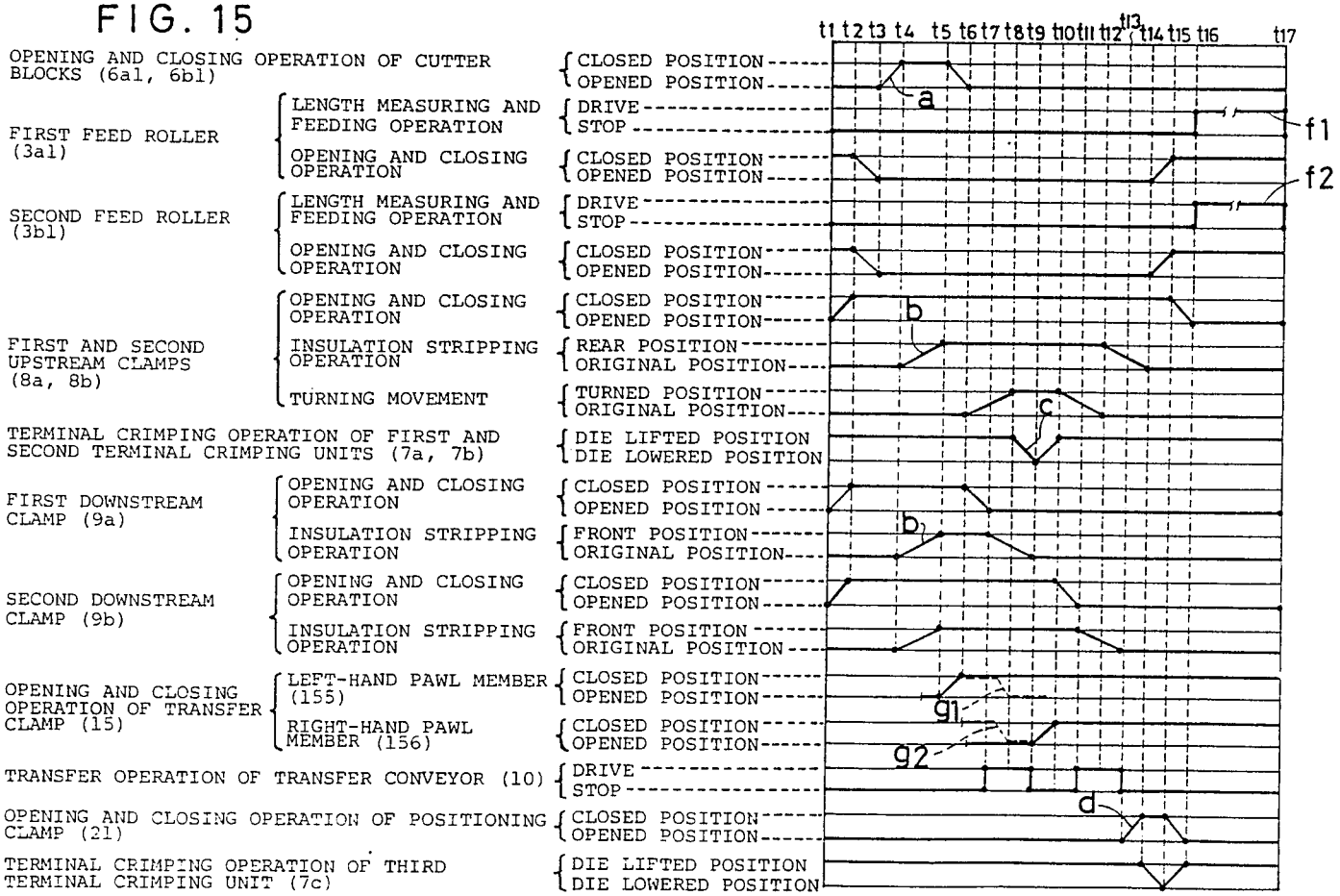
FIG. 15 is a timing chart.

The operation of the harness producing apparatus of the aforesaid construction will now be described in the order shown in the timing chart of FIG. 15. In FIG. 15,

| | |
|---|---|
| a: t3 → t4 | wire core cutting and insulation cutting operation; |
| b: t4 → t5 | insulation stripping operation; |
| c: t8 → t10 | crimping operation on terminals T1, T2; |
| d: t12 → t13 | trueing-up and positioning operation on rear ends of terminals T1, T2; |
| e: t13 → t15 | crimping operation on terminal T3; |
| f1, f2: t16 → t17 | length measuring and cutting operation on wires or cut wire sections W1, W2; and |
| g1, g2: t7 → t9 | releasing and discharging operation of the treated wire from a preceding work cycle. |

Let t1 (=t17) be the starting point of the description. At this starting time the first and second wire length measuring and feeding mchanism 3*a* and 3*b*, as shown in FIGS. 1 and 2, have just finished feeding the respective predetermined length of the first and second wires W1 and W2 by the rotation of the first and second feed rollers 3a1 and 3b1. It is assumed that the front or leading ends of said fed wires W1 and W2 have terminal T1 and T2 already attached thereto in the preceding cycle. Furthere, at this time, the cutter blocks 6a1 and 6b1 are in their opened state, and the nip pawls 8a1, 9a1 and 8b1, 9b1 of the first upstream and downstream clamps 8a and 9a and the second upstream and downstream clamps 8b and 9b are in the opened state with the first and second wires W1 and W2 positioned therein, respectively. The transfer conveyor 10 is stopped with one now open transfer clamp 15 stopped at a predetermined position on the first feed path defined by axis M1. This is the state shown in FIG. 4. The positioning clamp 21 is in the opened state as shown in FIG. 10.

Time t1→t4 . . . the nip pawls 8a1, 9a1 and 8b1, 9b1 are closed (t1→t2), the first and second feed rollers 3a1 and 3b1 are opened (t2→t3), and then the cutter blocks 6a1 and 6b1 are closed, whereby the respective core cutting blades C1 cut the fed wires W1 and W2 to predetermined lengths forming cut wire sections. At the same time, at positions spaced some predetermined distances forward or rearward from the positions cut by the core cutting blades C1, the respective insulation cutting blades C2 cut the insulation of the cut wires W1 and W2 in the rear end regions thereof (t3→t4) as viewed in the feed direction.

Time t4→t5 . . . while nipping remaining wires the first and second upstream clamps 8a and 8b are moved a predetermined distance rearwardly away from the cutter blocks 6a1 and 6b1, thereby stripping the insulation on the front end regions of the remaining wires. At the same time, nipping said cut wires W1 and W2, the first and second downstream clamps 9a and 9b are moved a predetermined distance forward away from the cutter blocks 6a1 and 6b1, thereby stripping the insulations on the rear end regions of said cut wires W1 and W2. At this time, the first downstream clamp 9a approaches the transfer clamp 15 which is standing by in the opened state.

Time t5→t6 . . . the cutter blocks 6a1 and 6b1 are open. By the operation of the closing mechanism 176, or as the operation rod 181 is pulled to the left, the left and right push members 178 and 179 are moved toward each other, whereby the left-hand push member 178 alone pushes the left-hand driven roller 170 upwardly. Therefore, an extendng operation of the links 162 and 163 causes the left-hand pawl member 155 to tilt in the closing direction, thus lifting the intermediate lifting pawl member 172 through the pinion 173, so that the intermediate pawl 172a is positioned adjacent the right-hand side of the cut wire W1 and the rear portion of the wire W1 is nipped between said intermediate pawl 172a and the V-shaped pawls 155b1 of the right-hand side pawl member 155, t5→t6, see the state shown in FIG. 5. Then, the first downstream clamp 9a opens the nip pawls 9a1 at t6→t7 and returns to the original position at t7→t9.

Time t6→t10 . . . with the completion of the opening of the cutter blocks 6a1 and 6b1, the first and second upstream clamps 8a and 8b tilt to the left to present the front insulation-stripped ends W1a and W2a of the remaining wires just above the crimping beds 7a2 and 7b2 of the first and second terminal crimping units 7a and 7b at t6→t8. At this time, terminals T1 and T2 are mounted on the crimping beds 7a2 and 7b2, respectively.

Figure 13:
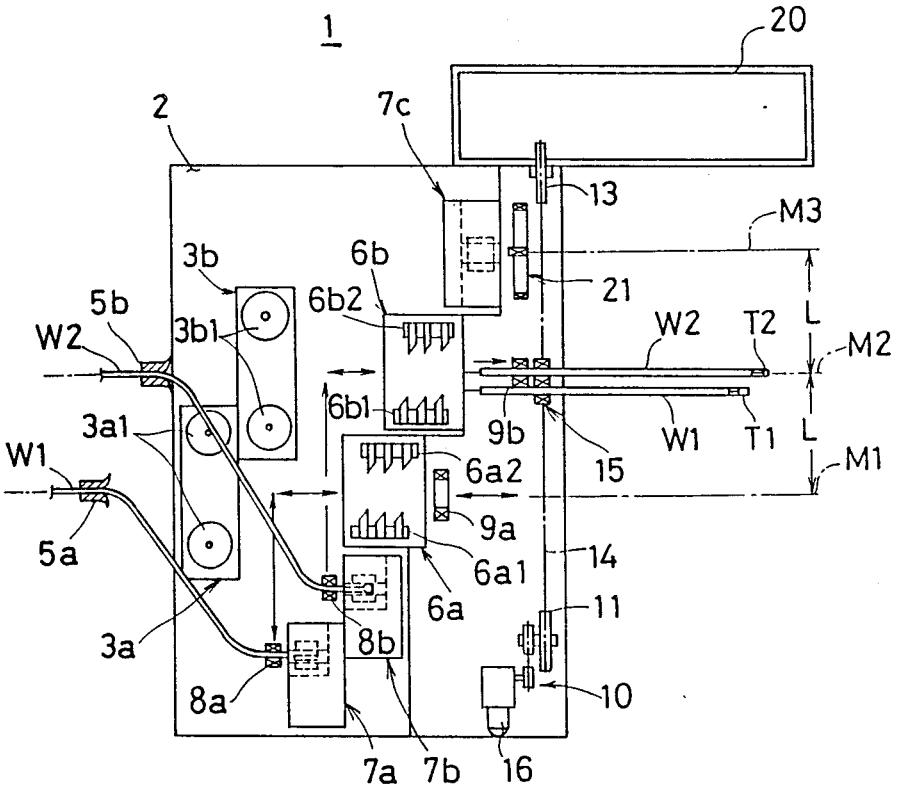
FIGS. 13 and 14 are function-explaining views similar to FIG. 2.

Thereafter, the first and second terminal crimping units 7a and 7b crimp the terminals T1 and T2 to the front insulation-stripped ends W1a and W2a by the lowering action of the crimping dies 7a3 and 7b3, respectively, see the state shown in FIG. 13, whereupon the crimping dies 7a3 and 7b3 move back to their original lifted positions at t8→t10.

Time t10→t14 . . . the first and second upstream clamps 8a and 8b turn back to the right at t10→t12, and move forward to return to their original positions at t12→t14, whereby the front end terminal T1-and-T2-attaching portions of the remaining wires W1 and W2 which have been nipped by the nip pawls 8a1 and 8bl, advance into the space between the opened cutter blocks 6a1 and 6b1 along the first and second feed path defined by the axes M1 and M2, respectively, see FIG. 7.

Figure 6:
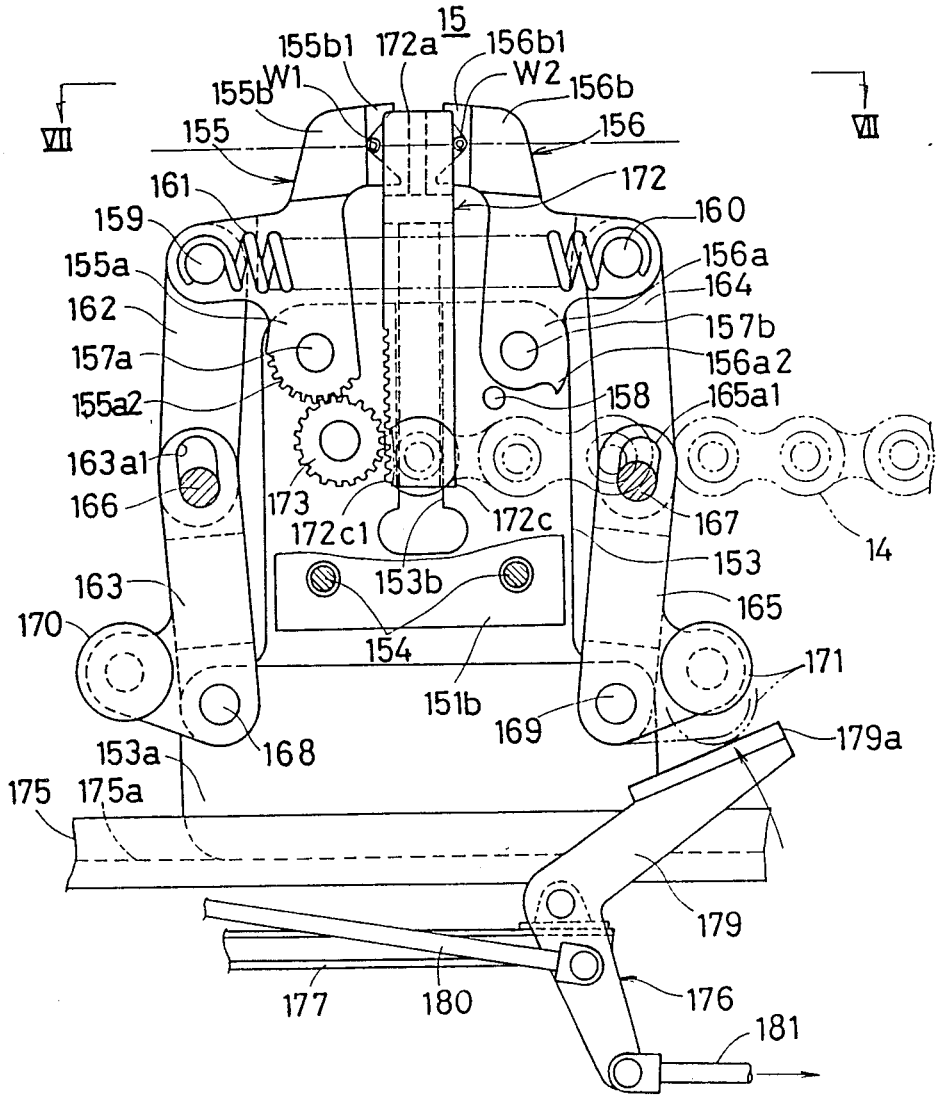
FIG. 6 is a detailed front view of the transfer clamp in the fully closed state.

Time t7→t13 . . . when the first downstream clamp 9a releases the cut wire W1 by the opening action of the nip pawls 9a1, the transfer conveyor 10 is driven at t7→t9, and while nipping the cut wire W1, the transfer clamp 15 is moved by one pitch corresponding to the distance L to the right. At the time t5 the clamp 15 arrives in front of the second downstream clamp 9b standing by at the front position. At this time, the second cut wire W2 nipped by the second downstream clamp 9b and extending rearwardly along the second feed axis contacts the right-hand side surface of the intermediate pawl 172a of the transfer clamp 15. This state is shown in phantom lines in FIG. 5. Then, the closing mechanism 176 is actuated again to tilt the left and right push members 178 and 179 toward each other, said right-hand push member 179 alone pushing the right-hand driven roller 171 upwardly. Therefore, by the extending action of the links 164 and 165, the right-hand pawl member 156 is tilted in the closing direction to nip the rear end of the cut wire W2 between the V-shaped pawls 156b1 and the intermediate pawl 172a at t9→t10. This state is shown in FIG. 6. On the other hand, the second downstream clamp 9b opens the nip pawls 9b1 at t10→t11 and moves back to the rear original position at t11→t13.

Time t11→t16 . . . upon completion of the opening of the second downstream clamp 9b, the transfer conveyor 10 is driven by another pitch during t11→t13, and the transfer clamp 15, nipping the two cut wires W1 and W2 parallel to each other, is moved through said distance L to the right, arriving in front of the positioning clamp 21 in the opened state, while the next new transfer clamp 15 in the opened state arrives on the first feed path defined by axis M1 to stand by. Thereafter, the positioning clamp 21 has its lifting cap member 213 lifted by the leftward push of the operating rod 222, whereby the operating bent arm 221 is tilted clockwise as viewed in FIG. 11 and the force of the compression spring 214 is released. At this time, the upper pawl 217a comes into the space between the cut wires W1 and W2 nipped by the transfer clamp 15, and out to the rear in a parallel relationship. The lifting of the cap member 213 causes the nip pawls 216a and 216b to tilt toward each other to nip the cut wires W1 and W2 between said upper pawl 217a and said nip pawls 216a, 216b at t13→t14. The rear insulation-stripped ends W1b and W2b of the cut wires W1 and W2, in their gathered and trued-up state shown in FIGS. 1 and 12 as a result of this nipping, are presented just above the crimping bed 7c2 of the third terminal crimping unit 7c. At this time, a terminal T3 has already been mounted on the crimping bed 7c2.

Figure 14:
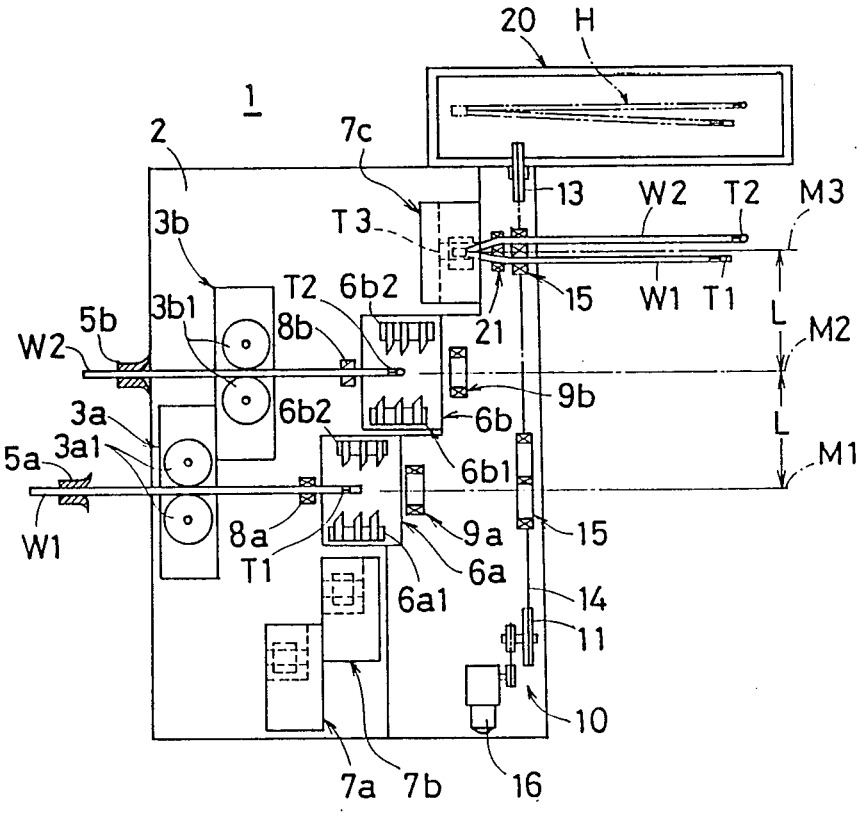

Time t14→t16 . . . at the third crimping bed 7c, the crimping die is lowered to crimp the terminal T3 to the rear trued-up insulation-stripped ends W1b and W2b of the cut wires W1 and W2 at t14→t15. This state is shown in FIG. 14. The crimping die returns to its original upper position at t15→t16. This operation provides a pine needle-shaped harness H shown in FIG. 3. Subsequent to the completion of the crimping, the positioning clamp 21 lowers the lifting cap member 213 against the force of the compression spring 214 by the rightward push of the operating rod 222 and the counterclockwise tilt of the operating bent arm 221, as viewed in FIG. 11. Thus, the cut wires W1 and W2 are released by the lowering of the upper pawl 217a and the leftward and rightward tilt, i.e., opening of the nip pawls 216a and 216b at t15→t16.

Time t14→t17 . . . at time t14, when the first and second upstream clamps 8a and 8b move back to the original positions, the first and second rollers 3a1 and 3b1 are closed again to nip the cut wires W1 and W2 at t14→t15. On the other hand, the nip pawls 8a1 and 8b1 of the second upstream clamps 8a and 8b are opened to release these wires W1 and W2 at t15→t16. Subsequently, the rotation of the first and second feed rollers 3a1 and 3b1 withdraws the first and second wires from the first and second stock rollers 4a and 4b and feeds these wires forward along the first and second feed paths defined by axes M1 and M2. The front end terminal T1-and-T2 attaching portions of the wires are passed between the cutter blocks 6a1 and 6b1, respectively, and then between the nip pawls 9a1 and 9b1 of the first and second downstream clamps 10a and 10b, with the first wire W1 being passed somewhat above the left-hand side of the intermediate lifting pawl member 172. When a respective predetermined length of wire has been fed out for each wire, the rotation of the first and second feed rollers 3a1 and 3b1 is stopped by the action of the length measuring unit at t17→t1. Thus, one cycle of harness producing operation is completed. By repeating the cycle during times t1 to t17, a number of harnesses H can be continuously and automatically produced. When a transfer clamp 15 turns around the sprocket 13 during the driving of the transfer conveyor 10 at the next time t7→t9, the driven rollers 171 and 170 successively engage the fixed cam 182a of the closing mechanism 182, so that the right and left pawl members 156 and 155 are opened to allow the harness H to drop into the container 20, where it is stored as shown in phantom lines in FIG. 1, and FIG. 9, and by dotted lines g1 and g2 in FIG. 15.

In the embodiment described above, the harness H has been described as consisting of two wires; however, it may comprise three or more wires.

Further, if the harness producing apparatus is adapted to set and compile the respective lengths and numbers of wires used to form a harness, the combination of lengths of wires W1 and W2 can be changed in each cycle.

In the embodiment described above, the chain 14 included in the transfer conveyor 10 is circulated in one direction and hence the transfer clamps 15 have been circulatorily moved in one direction. However, the transfer clamps may be arranged for translatory reciprocating motion.

In the embodiment described above, the transfer conveyor 10 including the chain 14 has been employed as transfer means for transferring a plurality of cut wires for collecting the wires at one location. However, as in an embodiment to be described below with reference to FIGS. 16 to 23, transfer means including a tiltable arm may be employed. In the embodiment shown in FIGS. 16 to 23, examples of change in the disposition of the cutting mechanisms and terminal crimping units are also suggested.

Figure 16:
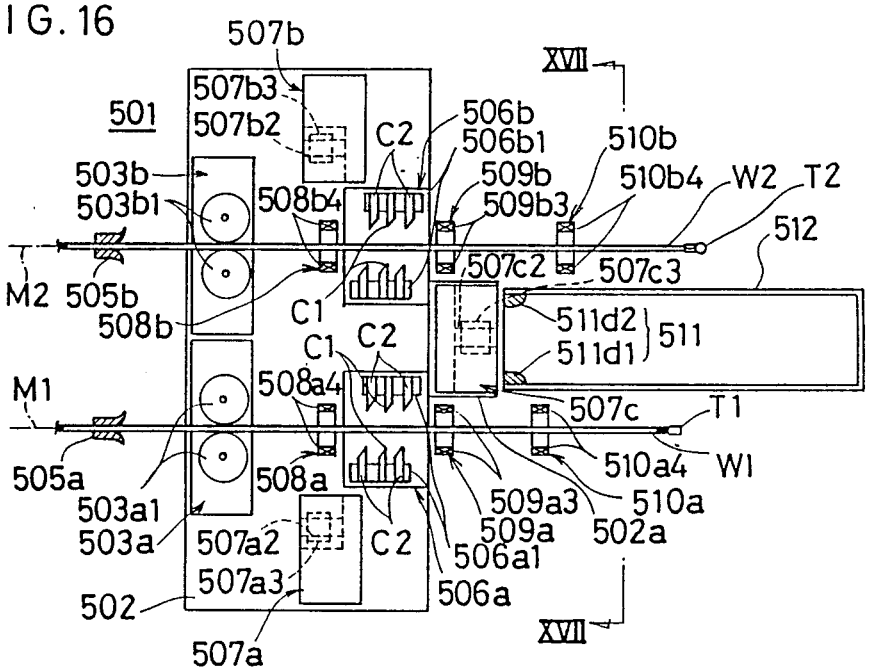
FIGS. 16 to 23 are views for explaining another embodiment of the invention; whereby
Figure 17:
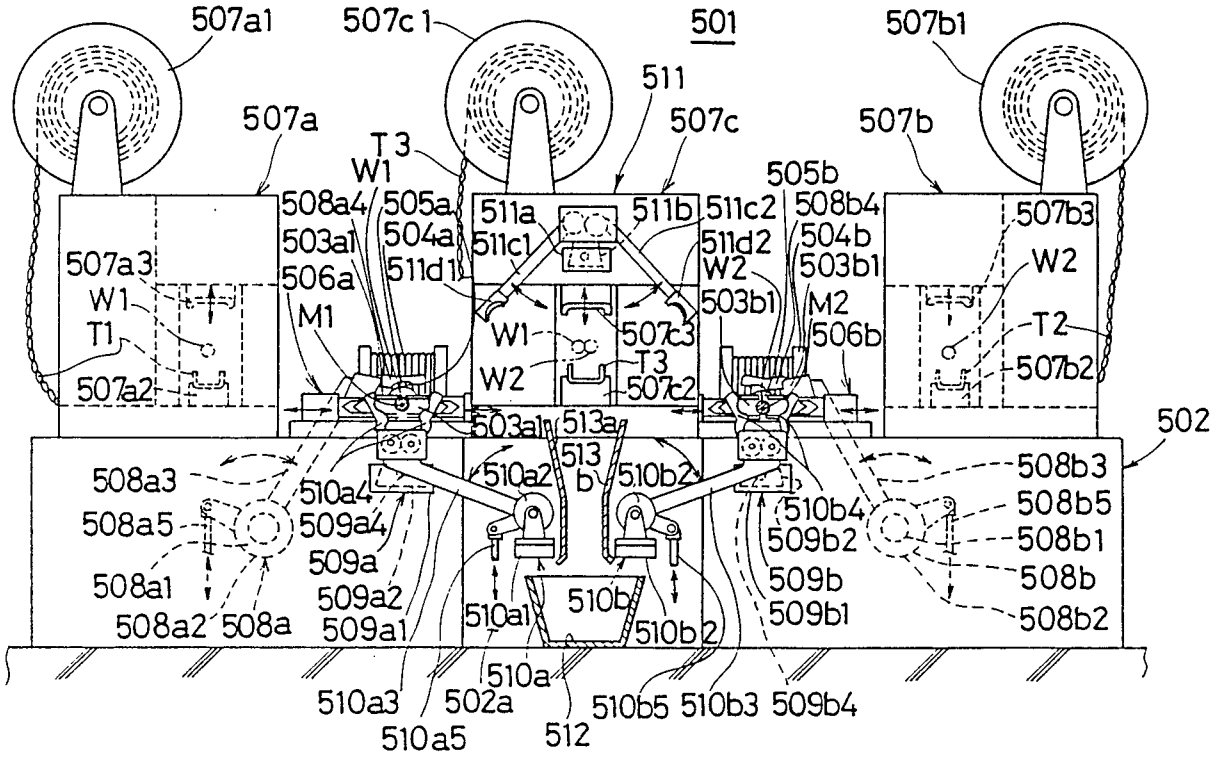

FIG. 16 is a complete schematic plan view of a harness producing apparatus 501 which forms another embodiment of the invention, and FIG. 17 is an enlarged front view taken along the line XVII—XVII in FIG. 16. For convenience of description, the left and right in FIGS. 17 and 23 will be called the "left" and "right", respectively, and the right and left in FIGS. 16 and 18 through 22 will be called "front" and "rear" or "downstream" and "upstream", respectively.

This harness producing apparatus 501 is adapted to automatically and continuously produce a so-called "pine needle-shaped" harness H, as shown in FIG. 3 described above, by fastening terminal T1 and T2 to one of the respective ends of two, first and second wires W1 and W2, trueing-up the other ends thereof and then fastening a common terminal T3 thereto.

A machine box 502 carries first and second wire length measuring and feeding mechanisms 503a, 503b installed on the upper surface of said machine box. The mechanisms 503a and 503b comprise, respectively, pairs of first and second feed rollers 503a1 and 503b1 for transporting first and second wires W1 annd W2 nipped between the rollers. The wires are delivered through guide tubes 505a and 505b from first and second stock rollers 504a and 504b. The wires are fed forward intermittently by predetermined lengths each time along first and second feed paths defined by axes M1 and M2.

First and second cutting mechanisms 506a and 506b are disposed forwardly of the first and second wire length measuring and feeding mechanisms 503a and 503. The cutting mechanisms 506a and 506b comprise, respectively, pairs of cutter blocks 506a1 and 506b1 including opposed core cutting blades C1 and insulation cutting blades C2 disposed on the upstream and downstream sides of the core cutting blades C1.

First, second and third terminal crimping units 507a, 507b and 507c, respectively, comprise terminal feeding reels 507a1, 507b1 and 507c1, crimping beds 507a2, 507b2 and 507c2 for mounting terminals delivered, one by one, from said reels, and crimping dies 507a3, 507b3 and 507c3 disposed above so that they can be lowered toward said crimping beds. The first and second terminal crimping units 507a and 507b have the crimping beds 507a2 and 507b2 symmetrically disposed therebehind. The opposed sides of the crimping beds 507a2 and 507b2 are opened to allow the first and second wires W1 and W2 to come in and out of places above said crimping beds 507a2 and 507b2. The third terminal crimping unit 507c has its crimping bed 507c2 disposed in the front middle region thereon, the right and left sides of said crimping bed being opened throughout to allow the first and second wires W1 and W2 to come in a place above the crimping bed 507c2.

First and second clamps 508a and 508b comprise respectively, fixed horizontal shafts 508a1 and 508b1 fixed in the machine box 502 just below said crimping beds 507a2 and 507b2. Arms 508a3 and 508b3 extend above the machine box 502 and are fixed to the peripheral surfaces of rotary slide bodies 508a2 and 508b2 in the form of doughnut-shaped disks rotatably and slidably inserted on the fixed horizontal shafts 508a1 and 508b1. Pairs of nip pawls 508a4 and 508b4 adapted to be opened and closed are attached to the upper ends of the arms 508a3 and 508b3. Turning mechanisms 508a5 and 508b5 turn the slide bodies 508a2 and 508b2 around the axes of said first horizontal shafts 508a1 and 508b1. Slide mechanisms not shown slide the arms back and forth along the horizontal shafts.

First and second downstream clamps 509a and 509b comprise, respectively, fixed blocks 509a1 and 509b1 horizontally projecting from the front surface of the machine box 2 and movable blocks 509a2 and 509b2 longitudinally slidably mounted on said fixed blocks 509a1 and 509b1. Pairs of nip pawls 509a3 and 509b3 capable of opening and closing are installed on said movable blocks 509a2 and 509b2. Sliding mechanisms 509a4 and 509b4 shift the movable blocks 509a2 and 509b2. The first and second feed axes M1 and M2 extend between the nip pawls 509a3 and 509b3, respectively.

In addition, the first and second upstream clamps 8a and 8b and the first and second downstream clamps 9a and 9b in the preceding embodiment have substantially the same construction as in the first and second upstream clamps 508a and 508b and the first and second downstream clamps 509a and 509b in this embodiment.

First and second transfer clamps 510a and 510b are disposed downstream of said first and second downstream clamps 509a and 509b. The transfer clamps 510a and 510b comprise respectively, brackets 510a1 and 510b1 projecting from a central projection on said machine box 502. Rotary bodies 510a2 and 510b2 are rotatably mounted on said brackets 510a1 and 510b1. Upwardly extending arms 510a3 and 510b3 are fixed at their proximal ends to the peripheral surfaces of said rotary bodies 510a2 and 510b2. A pair of nip pawls 510a4 and 510b4 capable of opening and closing, is attached to the upper ends of said arms 510a3 and 510b3. Turning mechanisms 510a5 and 510b5 turn the rotary bodies 510a2 and 510b2 around the horizontal axes so that the turning of the arms 510a3 and 510b3 causes the respective nip pawls 510a4 and 510b4 to be arcuately reciprocated between the positions of the first and second feed axes M1 and M2, FIG. 17, and a position forwardly above said crimping die 507c2, FIG. 23.

A positioning clamp 511 that can be opened and closed, is disposed forwardly of said third terminal crimping unit 507c, and comprises a fixed block 511a projecting forwardly of and above said crimping bed 507c2. A movable block 511b is horizontally slidably mounted on said fixed block 511a. A pair of downwardly extending arms 511c1 and 511c2 engages at its base the upper side of said movable block 511b. Nip pawls 511d1 and 511d2 are fixed in opposed relationship to the front ends of said opening and closing arms 511c1 and 511c2. When the arms 511c1 and 511c2 are closed, the nip pawls 511d1 and 511d2 are also closed somewhat forwardly above the crimping bed 507c2.

A top-opened harness collecting box 512 is disposed on the flow below and forwardly of the middle projection 502a on said machine box 502. Thus, when a harness H is completed by the third terminal crimping unit 507c, it is released by the opening of the positioning clamp 511 and passed between a pair of guide plates 513c and 513b projecting from the front surface of the middle projection 502a of the machine box, to be received by the harness collecting box 512.

The operation of the harness producing apparatus of the above construction will now be described. Let the state shown in FIGS. 16 and 17 be the starting point of description. In this state, the first and second length measuring and feeding mechanisms 503a and 503b have just fed out respective predetermined lengths of the first and second wires W1 and W2 by the rotation of the first and second feed rollers 503a1 and 503b1. The fed wires W1 and W2 have terminals T1 and T2 already attached to the front ends thereof in the preceding cycle. At this time, the cutter blocks 506a1 and 506b1 are in the opened state. The nip pawls 508a4, 509a3, 510a4 and 508b4, 509b3, 510b4 of the first upstream clamp 508a, the first downstream clamp 509a, the first transfer clamp 510a and the second upstream clamp 508b, the second downstream clamp 509b, the second transfer clamp 510b are in the opened state with the first and second axes M1 and M2 positioned therein. The positioning clamp 511 is in the original position and in the opened state.

Figure 18:
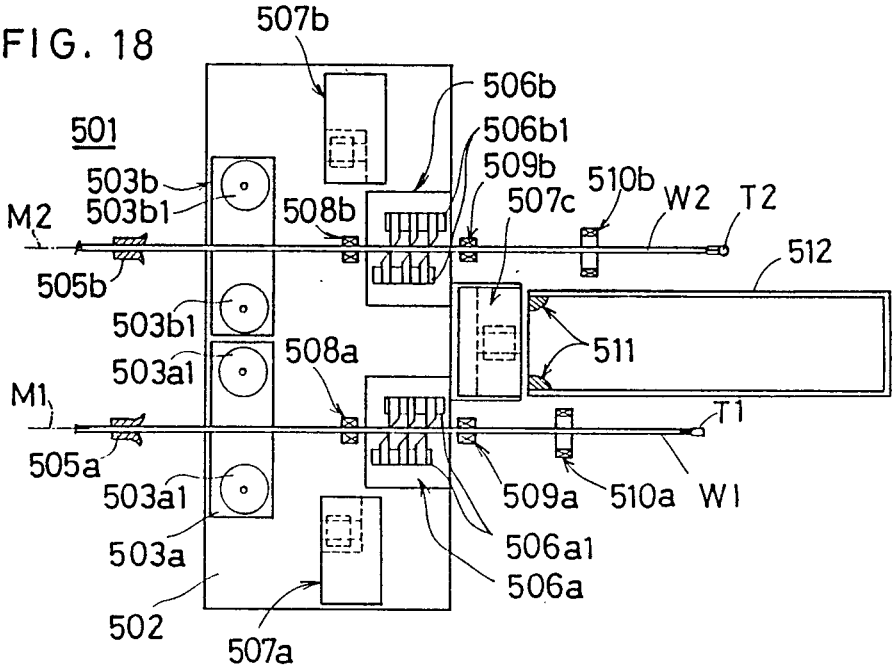

When the state of FIG. 16 changes to the state of FIG. 18, the nip pawls 508a4, 509a3 and 508b4, 509b3 are closed, then the first and second feed rollers 503a1 and 503b1 are opened and the cutter blocks 506a1 and 506b1 are closed, whereby the respective core cutting blades C1 cut the fed wires W1 and W2 to respective predetermined lengths. At the same time the respective insulation cutting blades C2 cut the insulations on the front ends of the remaining wires and on the rear ends of the cut wires W1 and W2 at positions somewhat spaced forward and rearward from the positions of cut by the core cutting blades C1.

Figure 19:
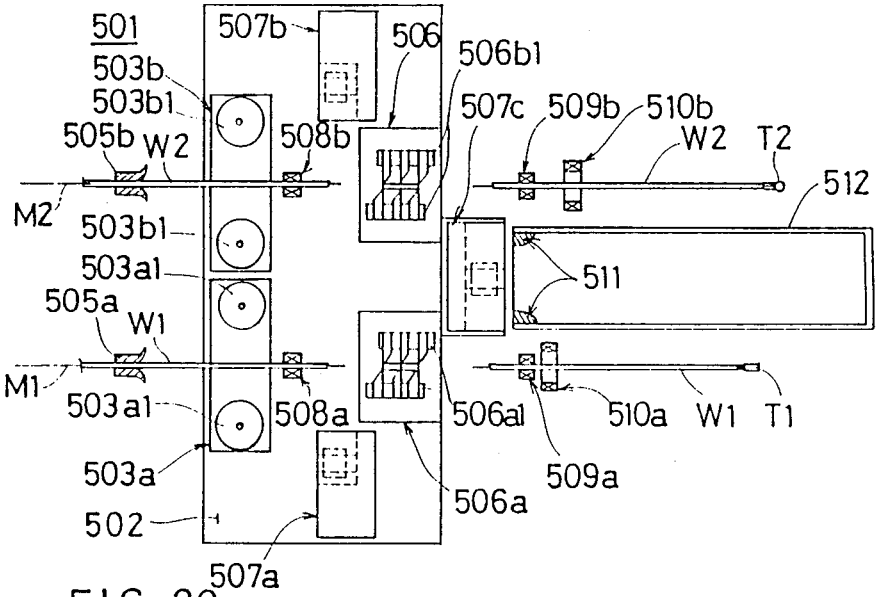

When the state of FIG. 19 is established, the first and second upstream clamps 508a and 508b, while nipping said remaining wires W1 and W2, are moved a predetermined distance rearwardly away from the cutter blocks 506a1 and 506b1, thereby stripping the insulations from the front ends of said remaining wires. At the same time, the first and second downstream clamps 509a and 509b, while nipping said cut wires W1 and W2, are moved a predetermined distance forward away from the cutter blocks 506a1 and 506b1, thereby stripping the insulations from the rear ends of said cut wires W1 and W2.

Figure 20:
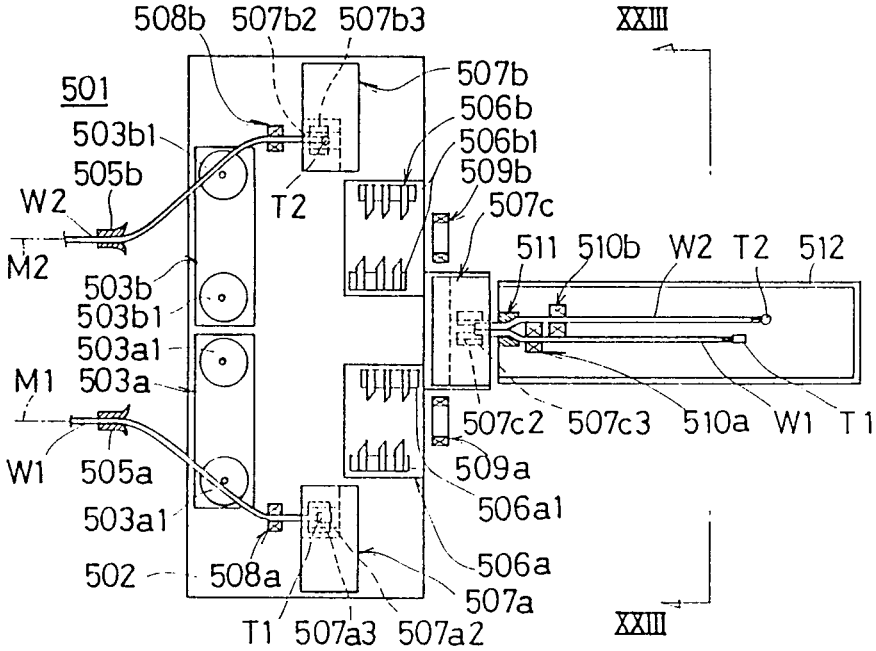

During the change from the state of FIG. 19 to the state of FIG. 20, the cutter blocks 506a1 and 506b1 are opened and the first and second transfer clamps 510a and 510b are closed to nip the rear ends of the cut wires W1 and W2 just downstream of the first and second downstream clamps 509a and 509b. Then, said first and second downstream clamps 509a and 509b are opened and moved rearwardly to their original positions.

When the opening of said cutter blocks 506a1 and 506b1 is completed, the first and second upstream clamps 508a and 508b are turned to present the front insulation-stripped ends of the remaining wires to positions just above the crimping beds 507a2 and 507b2 of the first and second terminal crimping units. At this time, there are terminals T1 and T2 mounted on said crimping beds 507a2 and 507b2, respectively. Then, the first and second terminal crimping units 507a and 507b crimp the terminals T1 and T2 to said front insulation-stripped ends by the lowering movement of the crimping dies 507a3 and 507b3, whereupon said crimping dies 507a3 and 507b3 move back to their original lifted positions.

Figure 21:
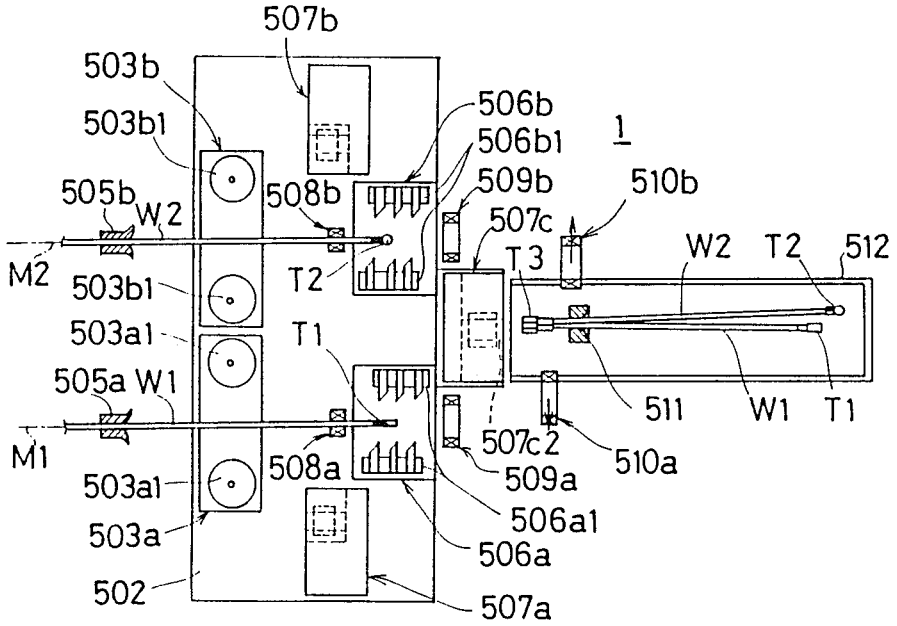

When the state of FIG. 20 changes to the state of FIG. 21, the first and second upstream clamps 508a and 508b turn to the right and left, respectively, and move forwardly to return to their original positions. Thereby, the front terminal T1-and-T2-attaching portions of the remaining wires move forward along the first and second feed axes M1 and M2 and into a space between the cutter blocks 506a1 and 506b1, respectively.

Figure 23:
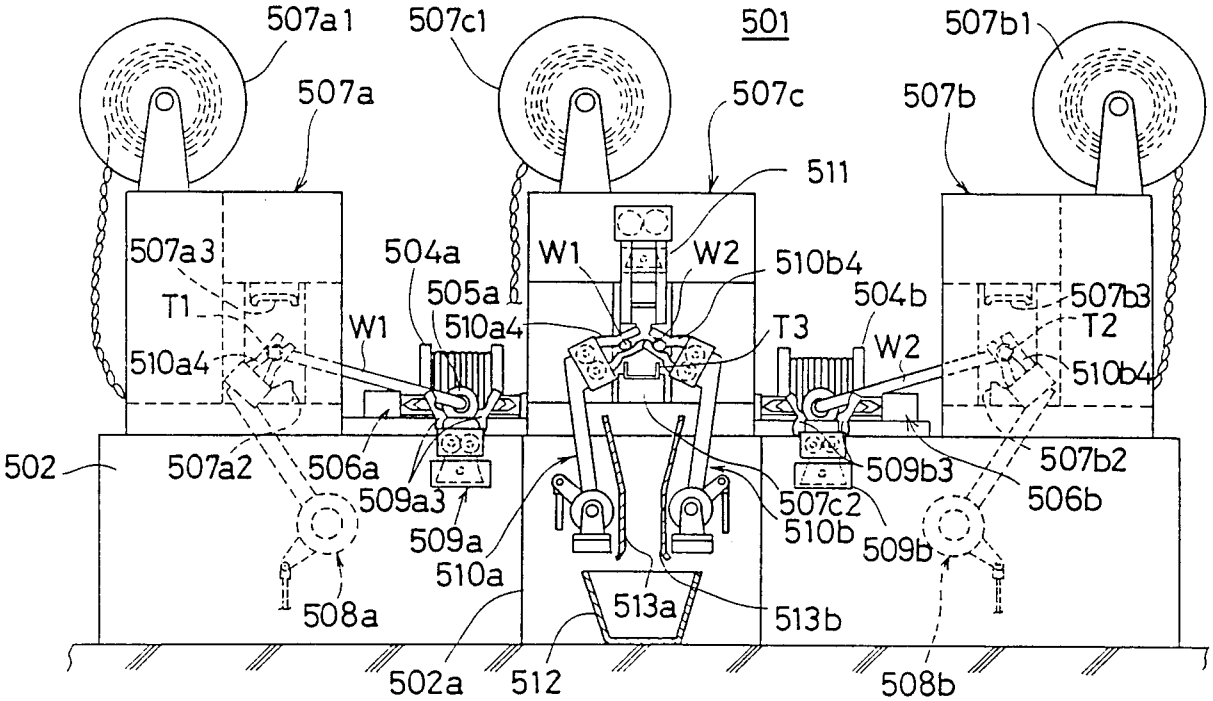

On the other hand, as described above, when the first and second downstream clamps 509a and 509b open they release the cut wires W1 and W2. Thus, these transfer clamps 510a and 510b are turned toward each other to place the cut wires W1 and W2 centrally in front of the third terminal crimping unit 507c. Then the arms 511c1 and 511c2 of the positioning clamp 511 are closed toward each other and the nip pawls 511d1 and 511d2 integrally nip the rear insulation portions of the cut wires W1 and W2 which leave the nip pawls 510a4 and 510b4 of said first and second transfer clamps 510a and 510b. Thereby, the rear insulation-stripped ends of the cut wires W1 and W2, in the trued-up state, are presented just above the crimping bed 507 as shown in FIGS. 20 and 23.

Then, in the third terminal crimping unit 507c, the crimping die 507c3 is lowered to crimp the terminal T3 to the rear trued-up insulation-stripped ends of the cut wires W1 and W2, whereupon said crimping die 507c3 moves back to its original lifted position. As a result, the cut wires W1 and W2 form a pine needle-shaped harness H as shown in FIG. 3.

Further, as shown in FIG. 21, the first and second transfer clamps 510a and 510b have their nip pawls 510a4 and 510b4 opened at the same time when the crimping of the terminal T3 is completed thereby turning away from each other.

During said turning-back of said first and second transfer clamps 510a and 510b, the positioning clamp 511 is moved somewhat forward, bringing the terminal T3-attached portion of the harness H forwardly away from the place just above the crimping bed 507c2 as shown in FIG. 21, and the positioning clamp 511 is opened to release the harness H. Therefore, the harness H is dropped between the guide plates 513a and 513b into the harness container 512. The positioning clamp 511 is moved back to its original forward position as shown in FIG. 22.

Figure 22:
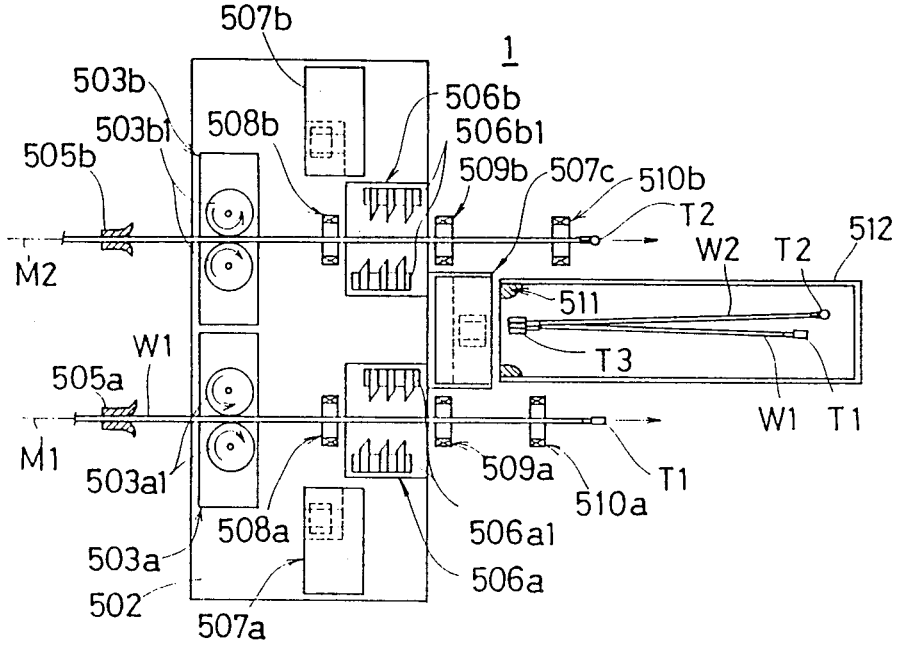

On the other hand, in the state shown in FIGS. 21, when the first and second upstream clamps 508a and 508b move back to their original positions, the first and second feed rollers 503a1 and 503b1 are closed to nip the cut wires W1 and W2, respectively, while the first and second upstream clamps 508a and 508b are opened to release the wires W1 and W2, FIG. 22. Subsequently, the rotation of the first and second feed rollers 503a1 and 503b1 causes the first and second wires to be withdrawn from the first and second stock rollers 504a and 504b are fed forward along the first and second feed axes. The front end terminal T1-and-T2-attaching portions of these wires are passed between the cutter blocks 506a1 and 506b1, respectively, and then between the nip pawls 510a4 and 510b4 of the first and second transfer clamps 510a and 510b, respectively, FIG. 22. When respective predetermined lengths of wire have been fed, the rotation of the first and second feed rollers 503a1 and 503b1 is stopped by the action of the length measuring units, whereby one cycle of harness H production is completed. By repeating the cycle, a number of harnesses H can be continuously and automatically produced.

Although the present invention has been described and illustrated in detail, it is clearly understood that the same is by way of illustration and example only and is not to be taken by way of limitation, the scope of the present invention being limited only by the terms of the appended claims.

What is claimed is:

1. A harness producing apparatus comprising: wire feeding means for intermittently feeding predetermined lengths of a plurality of insulated wires along predetermined feed paths, wire cutting means and insulation cutting means for cutting off from said insulated wires, insulated cut wire sections having said predetermined lengths to form remaining wire ends and said cut wire sections, and for cutting insulation on said remaining wire ends and on said cut wire sections, insulation stripping means for moving said remaining wire ends and said cut wire sections in the direction of said feed paths so as to strip off cut insulation from said remaining wire ends and from ends of said cut wire sections, single-wire terminal crimping means for crimping a terminal to each insulation-stripped remaining wire end of said insulated wires, transfer means including clamp means for parallelly nipping insulation-stripped ends of said cut wire sections to bring said insulation-stripped ends of said cut wire sections into a trued-up state, and for transferring said insulation-stripped ends of said cut wire sections at right angles to said feed paths, positioning means for nipping said insulation-stripped ends of said cut wire sections in said trued-up state and for presenting said insulation-stripped ends of said cut wire sections to a crimping position, and plurality-of-wires terminal crimping means for crimping one terminal to all said insulation-stripped ends of said cut-wire sections.

2. The harness producing apparatus as set forth in claim 1, wherein said transfer means comprises an endless chain intermittently and circulatorily driven in one direction, said chain providing a path which is at right angles to said feed paths, and said clamp means comprises a plurality of transfer clamps held by and equispaced on said endless chain.

3. The harness producing apparatus as set forth in claim 2, wherein each of said transfer clamps comprises a pawl member for individually nipping an insulation-stripping portion of each cut wire section, and link means for transmitting a nip action to said pawl member, said harness producing apparatus further comprising a closing mechanism which, when said transfer clamp is positioned on the path of travel of said endless chain which is at right angles with said feed paths, acts on said link means to apply a nip action to said pawl member.

4. The harness producing apparatus as set forth in claim 3, further comprising an opening mechanism which, when said transfer clamp has passed through the path of travel of said endless chain which is at right angles with said feed paths, acts on said link means to apply an action to release a cut wire section to said pawl member.

5. The harness producing apparatus as set forth in claim 1, wherein said positioning means comprises a plurality of pawl members for nipping the insulation-stripped ends of said plurality of cut wire sections, said pawl members having inclined surfaces for gathering said plurality of insulation-stripped ends at one point.

6. The harness producing apparatus as set forth in claim 1, wherein said transfer means comprises means for moving said cut wire sections in the direction of said feed paths while nipping at least one of said cut wire sections to properly position said plurality of insulation-stripped ends in the direction of said feed paths before the insulation-stripped ends of the cut wire sections are nipped by said clamp means.

7. The harness producing apparatus as set forth in claim 1, wherein said transfer means comprises an arm tiltable with one end thereof serving as a fulcrum, said transfer means being positioned at the other end of said arm.

8. A method of producing a harness by attaching terminals to one of the respective ends of a plurality of wires and gathering the other ends of said wires and attaching a single terminal thereto, said method comprising the steps of intermittently feeding a plurality of insulated wires by respective predetermined lengths along predetermined feed paths, cutting said insulated wires to respective predetermined lengths to divide them into remaining wires and cut wire sections while effecting the cutting of insulation on said remaining wires and on said cut wire sections, moving said remaining wires and said cut wire sections in the direction of said feed paths so as to strip said cut insulation, crimping terminals to insulation-stripped ends of said remaining wires, transferring the plurality of said cut wire sections for gathering in one place, trueing-up and nipping insulation-stripped ends of the gathered cut wire sections to present them to a crimping position, and crimping a terminal to positioned insulation-stripped ends.

* * * * *

UNITED STATES PATENT AND TRADEMARK OFFICE

CERTIFICATE OF CORRECTION

PATENT NO. : 4,862,587

DATED : September 5, 1989

INVENTOR(S) : Kenji Nakata, Kyo Tomonari, Takeo Yamanaka

It is certified that error appears in the above-identified patent and that said Letters Patent is hereby corrected as shown below:

Column 17:

Claim 7, line 4 of claim 7, replace "transfer means" by --arm--;
line 5 of claim 7, replace "arm." by --transfer means.--.

Signed and Sealed this

Twenty-sixth Day of March, 1991

*Attest:*

HARRY F. MANBECK, JR.

*Attesting Officer*

*Commissioner of Patents and Trademarks*